US007723605B2

(12) United States Patent
Gremo et al.

(10) Patent No.: US 7,723,605 B2
(45) Date of Patent: May 25, 2010

(54) FLUTE CONTROLLER DRIVEN DYNAMIC SYNTHESIS SYSTEM

(75) Inventors: Bruce Gremo, No. 9 Fang Yuan Nan Li Richmond Park, 1-1-1005 Chaoyang District, Beijing (CN) 100016; Jeff Feddersen, Brooklyn, NY (US)

(73) Assignee: Bruce Gremo, Beijing (CN)

( * ) Notice: Subject to any disclaimer, the term of this patent is extended or adjusted under 35 U.S.C. 154(b) by 216 days.

(21) Appl. No.: 11/729,027

(22) Filed: Mar. 27, 2007

(65) Prior Publication Data

US 2007/0261540 A1 Nov. 15, 2007

Related U.S. Application Data

(60) Provisional application No. 60/787,148, filed on Mar. 28, 2006.

(51) Int. Cl.
*G10H 1/00* (2006.01)

(52) U.S. Cl. ..... 84/723; 84/615

(58) Field of Classification Search ..... 84/615, 84/632, 653, 662, 723–725, 729, 730, 733, 84/734, 737, 738, 742–745
See application file for complete search history.

(56) References Cited

U.S. PATENT DOCUMENTS

| | | | | | |
|---|---|---|---|---|---|
| 2,138,500 | A | * | 11/1938 | Miessner | 84/723 |
| 2,301,184 | A | * | 11/1942 | Arnold | 84/742 |
| 2,868,876 | A | * | 1/1959 | Ticchioni | 381/70 |
| 3,429,976 | A | * | 2/1969 | Tomcik | 84/730 |
| 3,439,106 | A | * | 4/1969 | Goodale | 84/711 |
| 3,767,833 | A | * | 10/1973 | Noble et al. | 84/673 |
| 3,844,304 | A | * | 10/1974 | Boothe | 137/7 |
| 3,897,708 | A | * | 8/1975 | Suzuki | 84/678 |
| 3,938,419 | A | * | 2/1976 | De Rosa | 84/678 |
| 4,085,646 | A | * | 4/1978 | Naumann | 84/633 |
| 4,151,368 | A | * | 4/1979 | Fricke et al. | 84/736 |
| 4,178,821 | A | * | 12/1979 | Gallina et al. | 84/685 |
| 4,203,338 | A | * | 5/1980 | Vidas | 84/678 |
| 4,252,045 | A | * | 2/1981 | Nagura | 84/687 |
| 4,619,175 | A | * | 10/1986 | Matsuzaki | 84/644 |
| 4,741,240 | A | * | 5/1988 | Kawano et al. | 84/380 C |
| 4,757,737 | A | * | 7/1988 | Conti | 84/681 |
| 4,915,008 | A | * | 4/1990 | Sakashita | 84/658 |
| 4,919,032 | A | * | 4/1990 | Sakashita | 84/653 |
| 4,939,975 | A | * | 7/1990 | Sakashita | 84/626 |
| 4,984,499 | A | * | 1/1991 | Schille | 84/734 |
| 4,993,307 | A | * | 2/1991 | Sakashita | 84/615 |

(Continued)

FOREIGN PATENT DOCUMENTS

JP 07199919 A * 8/1995

*Primary Examiner*—David S. Warren
(74) *Attorney, Agent, or Firm*—Morgan, Lewis & Bockius LLP

(57) ABSTRACT

The present invention is an electronic musical instrument that in appearance and playing characteristics closely resembles flute-like instruments such as a conventional flute or a shakuhachi. The instrument comprises an electronic controller that has operating characteristics that resemble a flute and computer software executable on a computer for converting signals from the controller into data suitable for generating complex sound from conventional speakers. Thus, the instrument provides the complexity and nuance of control of an acoustic instrument while being capable of generating sounds that an acoustic instrument cannot make.

17 Claims, 15 Drawing Sheets

U.S. PATENT DOCUMENTS 4,993,308 A * 2/1991 Villeneuve ..... 84/724
5,010,801 A * 4/1991 Sakashita ..... 84/735
5,014,586 A 5/1991 Sakashita
5,024,133 A * 6/1991 Nakanishi et al. ..... 84/615
5,036,745 A * 8/1991 Althof, Jr. ..... 84/656
5,056,400 A 10/1991 Wachi et al.
5,065,659 A 11/1991 Uchiyama et al.
5,069,106 A * 12/1991 Sakashita ..... 84/626
5,069,107 A * 12/1991 Sakashita ..... 84/659
D323,340 S 1/1992 Sato
5,117,729 A * 6/1992 Kunimoto ..... 84/660
5,140,888 A 8/1992 Ito
5,149,904 A * 9/1992 Kamiya et al. ..... 84/723
5,153,364 A 10/1992 Uchiyama et al.
5,170,003 A 12/1992 Kawashima
5,179,242 A 1/1993 Usa
5,187,313 A 2/1993 Inoue
5,189,240 A * 2/1993 Kawashima ..... 84/724
5,245,130 A * 9/1993 Wheaton ..... 84/742
5,286,913 A * 2/1994 Higashi ..... 84/622
5,286,914 A 2/1994 Kunimoto
5,298,678 A 3/1994 Higashi
5,300,729 A 4/1994 Tokunaga
5,315,060 A 5/1994 Paroutaud
5,340,942 A * 8/1994 Kunimoto ..... 84/661
5,359,146 A 10/1994 Funaki et al.
5,371,317 A 12/1994 Masuda
5,403,966 A 4/1995 Kawashima et al.
5,451,711 A 9/1995 Kunimoto
5,453,571 A 9/1995 Adachi et al.
5,477,004 A 12/1995 Kunimoto
5,498,836 A * 3/1996 Okamoto et al. ..... 84/658
5,521,328 A * 5/1996 Kakishita ..... 84/661
5,543,580 A * 8/1996 Masuda ..... 84/723
5,563,359 A 10/1996 Okamura
5,668,340 A * 9/1997 Hashizume et al. ..... 84/742
5,712,439 A 1/1998 Toshifumi
5,804,751 A 9/1998 Koseki et al.
D403,695 S 1/1999 Katsumata
6,143,968 A * 11/2000 Tonon ..... 84/375
6,392,135 B1 5/2002 Kitayama
6,470,399 B1 10/2002 Tasler
6,538,189 B1 3/2003 Ethington
6,574,571 B1 * 6/2003 Bonnat ..... 702/48
6,660,920 B2 12/2003 Osuga
6,737,571 B2 5/2004 Furukawa
6,815,599 B2 11/2004 Asahi
D504,146 S 4/2005 Suzuki
6,881,890 B2 4/2005 Sakurada
6,933,494 B2 8/2005 Kato et al.
6,949,705 B2 9/2005 Furukawa
6,995,307 B2 * 2/2006 Britton ..... 84/387 R
7,002,068 B2 2/2006 Koseki et al.
7,049,503 B2 * 5/2006 Onozawa et al. ..... 84/723
7,217,878 B2 * 5/2007 Ludwig ..... 84/609
7,220,903 B1 * 5/2007 Bronen ..... 84/383 R
7,250,877 B2 * 7/2007 Bonnat ..... 341/21
7,321,094 B2 * 1/2008 Sakurada ..... 84/616
2002/0124712 A1 9/2002 Osuga
2003/0101862 A1 6/2003 Furukawa
2003/0167896 A1 * 9/2003 Vanden et al. ..... 84/279
2003/0177890 A1 9/2003 Furukawa
2003/0196539 A1 10/2003 Koseki et al.
2003/0208334 A1 * 11/2003 Bonnat ..... 702/135
2004/0144239 A1 7/2004 Sakurada
2004/0168564 A1 9/2004 Koseki et al.
2005/0056141 A1 3/2005 Uchara
2005/0217464 A1 10/2005 Onozawa et al.
2006/0000343 A1 1/2006 Koseki et al.
2006/0005691 A1 1/2006 Koseki et al.
2006/0027069 A1 2/2006 Ura et al.
2006/0185502 A1 * 8/2006 Nishitani et al. ..... 84/615
2007/0017352 A1 * 1/2007 Masuda ..... 84/658
2007/0137468 A1 * 6/2007 Shibata ..... 84/723
2007/0144336 A1 * 6/2007 Fujii ..... 84/723
2007/0180977 A1 * 8/2007 O'Hara ..... 84/377
2008/0047415 A1 * 2/2008 Schultz ..... 84/723

* cited by examiner tracks pads (body)
microphones (mouthpiece)
250
108
power input
309
106
305
308
306
307

250
108
power input
310
309
106
308
311
305
306
307
313
312

FLUTE CONTROLLER DRIVEN DYNAMIC SYNTHESIS SYSTEM

CROSS REFERENCE TO PROVISIONAL APPLICATION

This application claims the benefit of provisional application No. 60/787,148, filed Mar. 28, 2006, which is incorporated herein in its entirety.

SOFTWARE APPENDIX

The software programs on the enclosed CD-ROM Appendix, attached to the file of this patent application, with identical CD-ROM Copy 1 and Copy 2, are incorporated by reference herein. The software programs are: File name: CiliaASCII.txt; Created: Mar. 27, 2006; Size (bytes): 201,000; and File name: CiliaMicroprocessorASCII.txt; Created: Mar. 27, 2006; Size (bytes): 42,000.

BACKGROUND OF THE INVENTION

This relates to an electronic musical instrument. Keyboard and percussion electronic musical instruments are widely known. There is a need, however, for electronic musical instruments that are based on other types of musical instruments such as wind instruments.

SUMMARY OF THE INVENTION

The present invention is an electronic musical instrument that in appearance and playing characteristics closely resembles flute-like instruments such as a conventional flute or a shakuhachi. The instrument comprises an electronic controller that has operating characteristics that resemble a flute and computer software executable on a computer for converting signals from the controller into data suitable for generating complex sound from conventional speakers. Thus, the instrument provides the complexity and nuance of control of an acoustic instrument while being capable of generating sounds that an acoustic instrument cannot make.

In a preferred embodiment the controller comprises a housing, a mouthpiece mounted on the housing, and a plurality of finger track pads mounted on the housing and positioned so that a player's fingers can engage the track pads while the mouthpiece is held to his or her mouth. In a preferred embodiment, the mouthpiece comprises a wind separator having first and second major surfaces and a microphone mounted on each of the first and second surfaces. The wind separator splits the player's air column using an open lip technique while the microphones function as amplitude sensors. Preferably, there are five track pads positioned to be engaged by two fingers of each hand and one of the player's thumbs. Preferably, the controller also comprises a power amplifier for amplifying the signals from the microphones and a microprocessor for processing the signals from the track pads.

The computer software processes breathing events detected by the microphones and fingering events detected by the track pads and uses the resulting signals to control a plurality of signal synthesizers and envelope generators. In a preferred embodiment, the signals from the track pads are processed by a microprocessor and forwarded via a USB MIDI interface to the computer while the signals from the microphones are forwarded via a Firewire audio interface to the computer. The signals output from the computer are supplied via the Firewire audio interface to a mixer, a power amplifier and finally to a speaker system.

BRIEF DESCRIPTION OF THE DRAWINGS

These and other objects, features and advantages of the invention will be more readily apparent from the following Detailed Description in which.

DETAILED DESCRIPTION OF THE INVENTION

Figure 1:
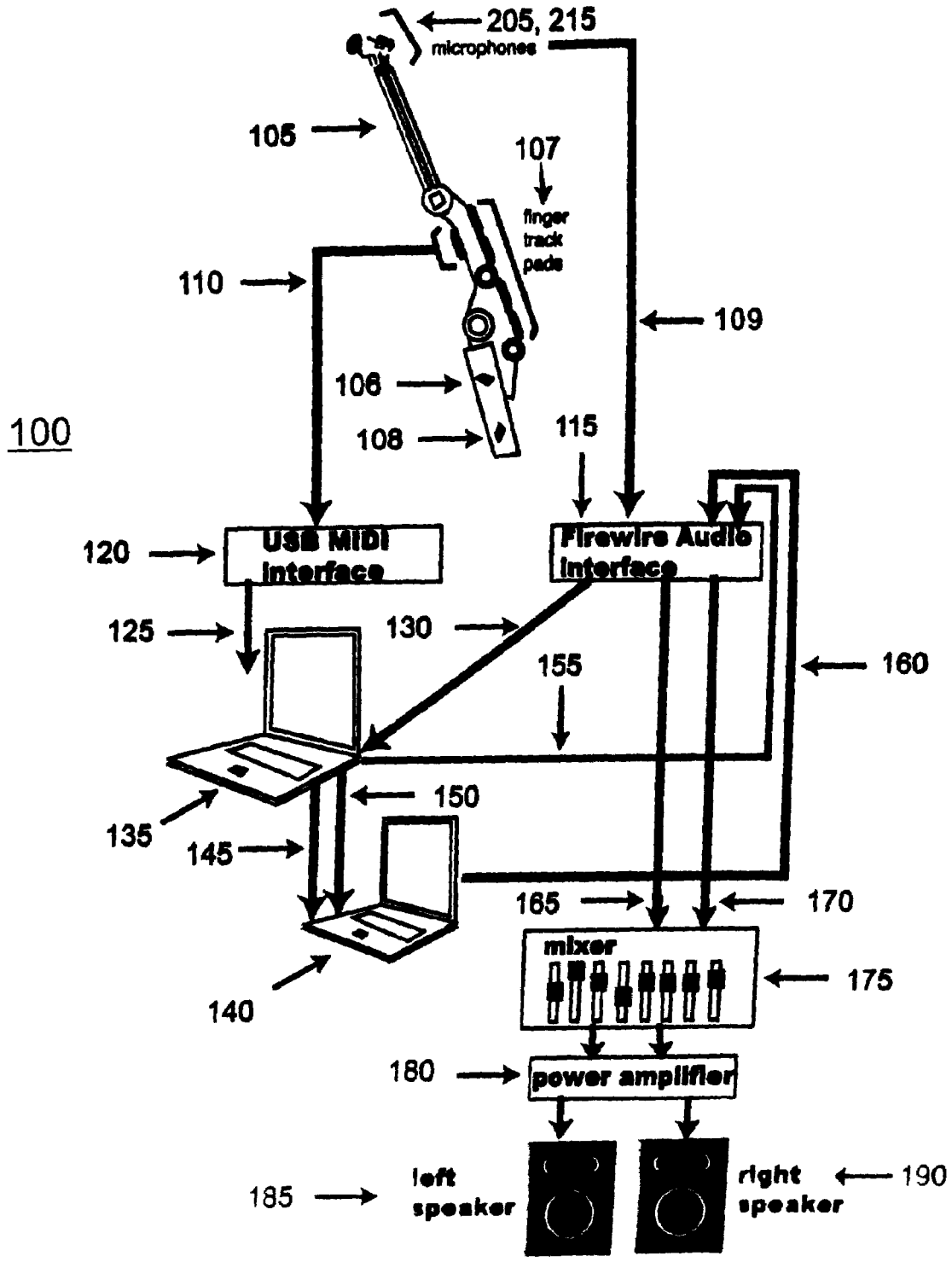
FIG. 1 is a schematic illustration of an illustrative embodiment of an electronic musical system of the present invention.

The present invention is a flute controller driven dynamic synthesis system 100 schematically depicted in FIG. 1. System 100 comprises a controller 105, first and second interfaces 115 and 120, first and second computers 135, 140, mixer 175, power amplifier 180 and left and right speakers 185 and 190. Controller 105, which is described in more detail in FIGS. 2A, 2B, 3, 4A-C, 5A and 5B includes first and second microphones 205 and 215, a preliminary microphone amplifier 106, finger track pads 107, and a finger track pad microprocessor 108. Illustratively, the microphones are model number EM 6050N-51 microphones manufactured by Shenzhen Horn Industrial Corp. The microphones are connected by a standard RCA audio cable (not shown) to the preliminary microphone amplifier 106. In one embodiment of the invention the specific finger track pads 225, 230, 235, 240, 245 are the TouchPad StampPad Module Model TM41P-240 manufactured by Synaptics Inc. The finger track pads are connected by specialty cable made by PARLEX CORP, model number 1598 AWM STYLE 20890 (not shown) to the finger track pad microprocessor 108. Illustratively, microprocessor 108 is a PIC 18F886 from Microchip, Inc., running at 40 MHz.

A standard ¼ inch audio cable 109 connects to first interface 115; and a cable 110 connects microprocessor 108 to second interface 120. A USB cable 125 connects second interface 120 to first computer 135. Cables 130 and 155 connect first interface 115 to first computer 135 and back. An Ethernet cable connection 145 and an audio signal cable 150 extend from first computer 135 to second computer 140; and an audio signal cable 160 extends from second computer 140 to first interface 115. Stereo and audio cables 165 and 170 extend from first interface 115 to audio mixer 175 and from the mixer to power amplifier 185 and then to the left and right speakers 185 and 190.

Preferably, microphone amplifier 106 is connected to a Firewire audio interface 115. Firewire is a recording industry standard protocol for transmission of audio data, such as, for instance, a Metric Halo Mobile I/O, or a comparable 8-channel in and out interface. Preferably, microprocessor 108 implements the MIDI protocol; and as a non-limiting example, the second interface 120 is a MOTU MIDI Express XT. Like all comparable commercial products, it enables many routing options for large amounts of data. It is capable of handling far greater amounts of data transmission than is generally needed for the present invention.

The use of second computer 140 is optional. Three types of control data are provided at the output of first computer 135: basic note data, volume data, and preset changes. In the absence of the second computer, this data is passed back by Firewire cable 155 into the Firewire interface 115 where it controls the signals provided to the sound system via cables 165 and 170. In the alternative, the control data from first computer 135 is provided to second computer 140 where it undergoes additional processing. In that case, the output from second computer 140 is routed back into the Firewire interface 115, where it controls the signals provided to the sound system.

While the use of a second computer 140 is not needed for fully functional performance, it is generally useful to accomplish more dynamic musical objectives in terms of categories of timbre or sonic color, and the way in which multiple simultaneous voices are brought into relation with one another, call it voicing or layering. There are four categories of timbre: instrument timbre, harmonic timbre, timbre density, and texture. Of voicing and layering, there are likewise four: monophony, homophony, heterophony and polyphony. Together, these concepts enable description of the inner horizon of sound. The accomplishment of dynamic musical objectives entails complex synthesis, which in turn requires a large amount of CPU expenditure. All of the synthesis could be packed into one application, but only at the expense of slower response to the controller.

Figure 2A:
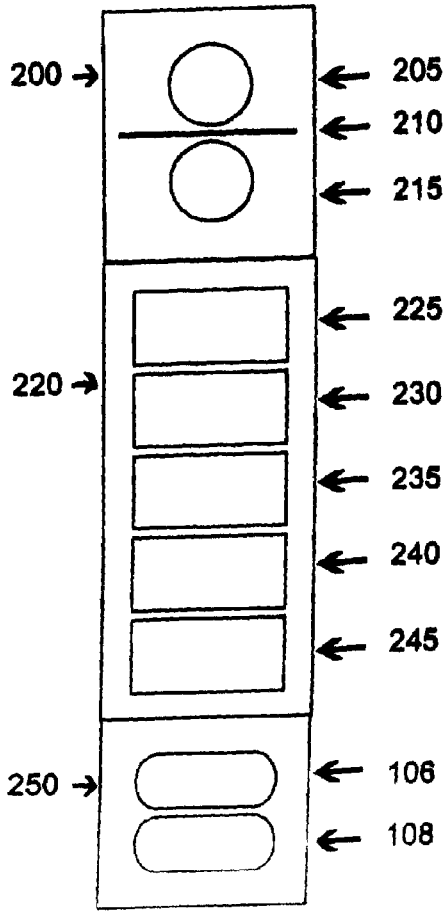
FIGS. 2A and 2B are a schematic illustration and a side view of an illustrative embodiment of a controller for the present invention.
Figure 2B:
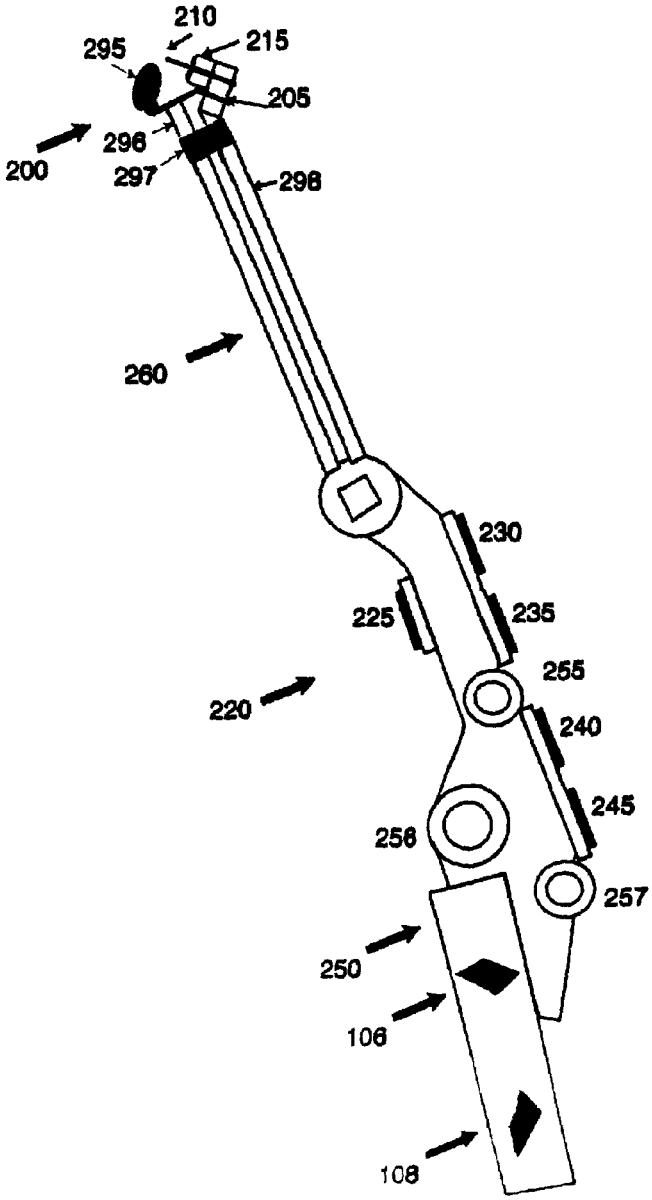
Figures 5A, 5B:
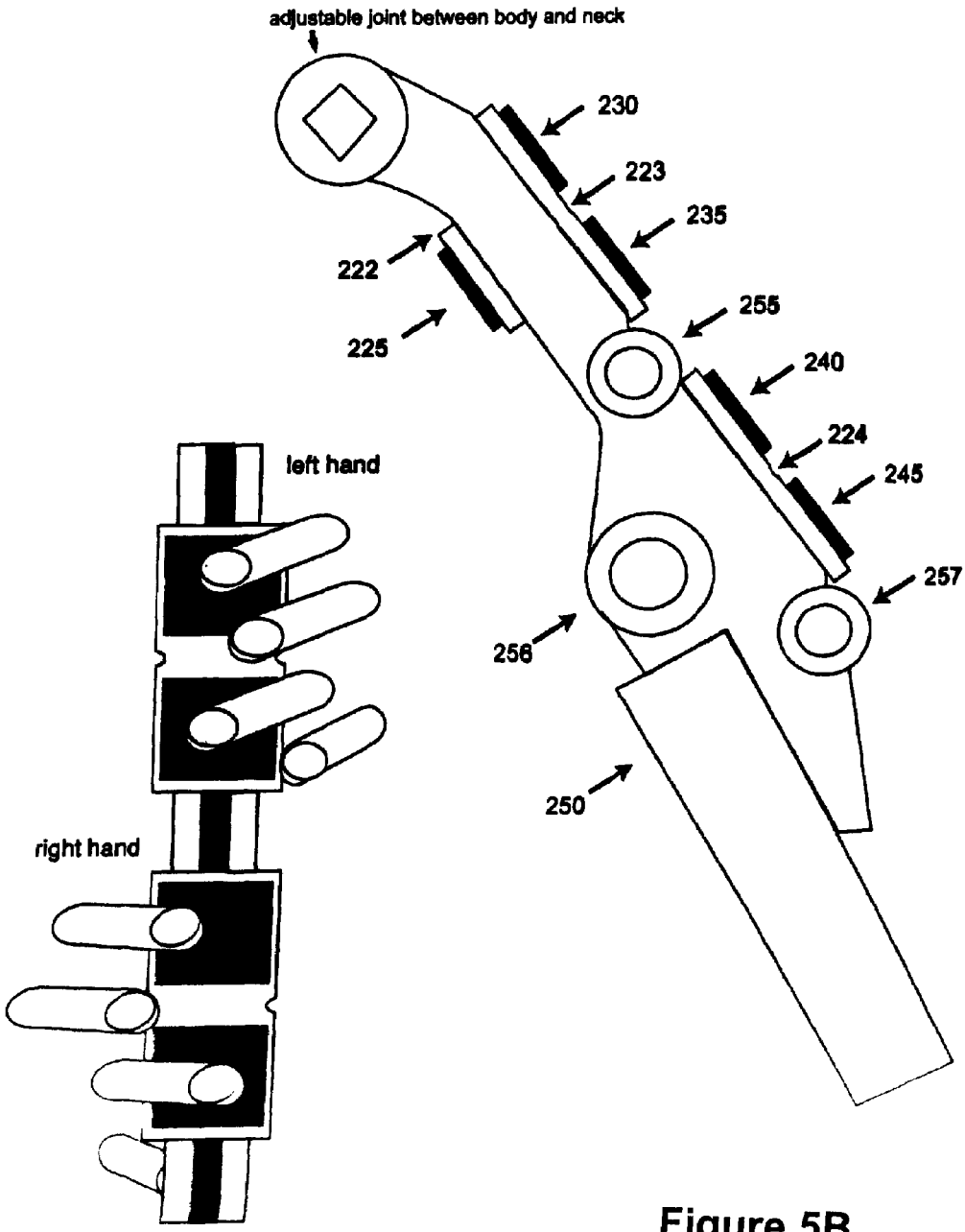
FIGS. 5A and 5B are a frontal view and a side view of track pads of the present invention.

Referring to FIGS. 2A and 2B, in one embodiment, controller 105 comprises four main interconnected parts: a mouthpiece 200 into which a player blows air, a neck 260, a housing 220 supporting a fingering mechanism, and an enclosure 250 for a circuit board (not shown). Mouthpiece 200 comprises an outside microphone 215, an inside microphone 205, a wind separator 210 and a lip plate 295. The terms "inner" or "inside" are indicative of a position closer to a player than a position modified with "outer" or "outside." Neck 260 of the flute controller comprises an outer tube 298, an inner tube 296, and a stabilizer 297. Tubes 298 and 296 connect the mouthpiece 200 with the housing of the flute controller 220. The tubes provide structural support and one of them carries the microphone cables within. Stabilizer 297 prevents tubes 298 and 296 from drifting and wobbling. In one embodiment of the invention, the neck 260 can be folded down for convenience in transporting the instrument, as well as to enable variable angles that the player may feel more physically comfortable with while performing. Housing 220 comprises finger track pads 225-245 and finger holes 255, 256 and 257. Finger track pads are manipulated with, as a non-limiting example, the following: pad 225—left hand thumb, pad 230—left index finger, pad 235—left ring finger, pad 240—right index, and pad 245—right ring finger as illustrated in FIG. 5A. Enclosure 250 encloses a circuit board shown in FIGS. 6A and 6B which includes the microprocessor 108 and the preliminary microphone amplifier 106. In one embodiment of the invention, the circuit board additionally includes cable ports.

Figure 4B:
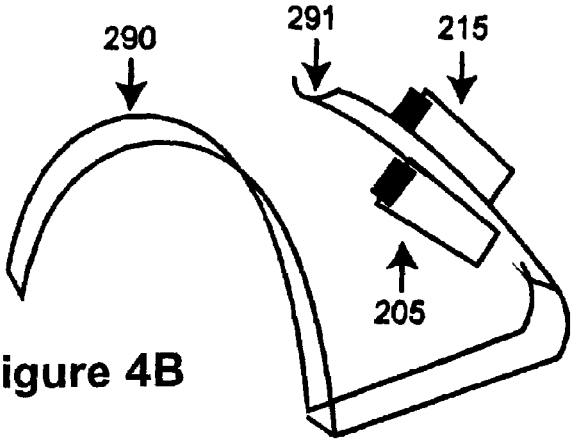
FIGS. 4A, 4B and 4C are illustrations of alternative embodiments of mouthpieces of the present invention.
Figure 4C:
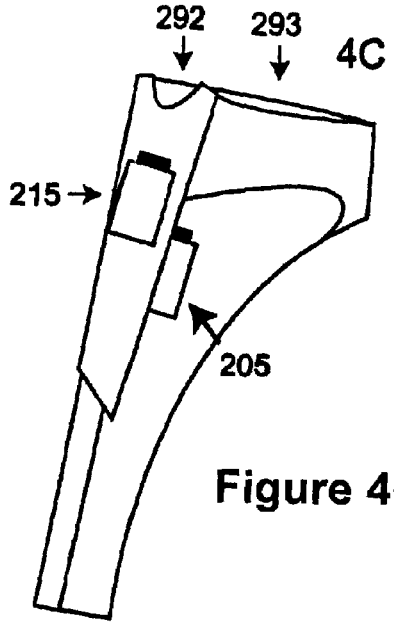
Figure 4A:
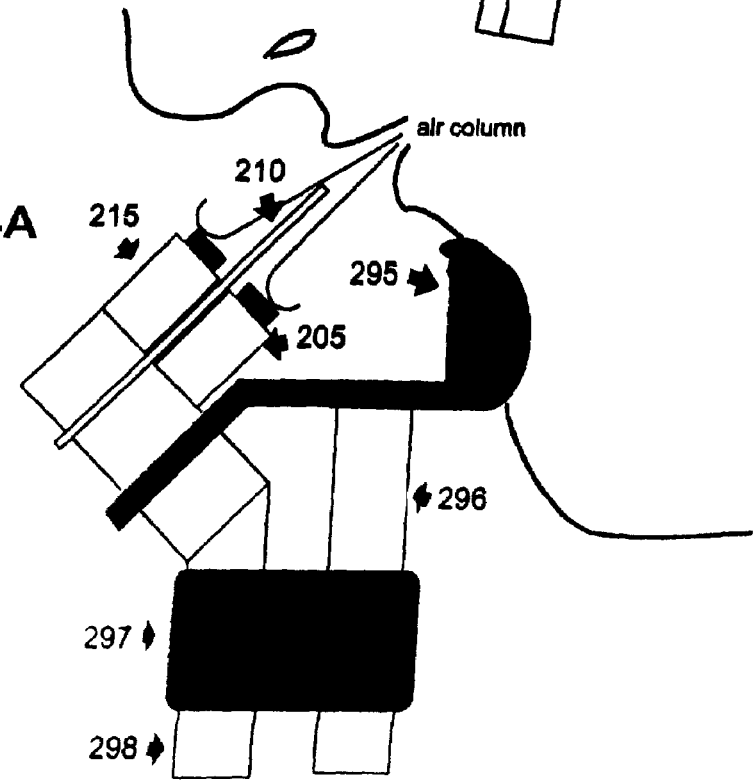

Referring to the side view of FIGS. 2B and 4A, wind separator 210 facilitates the splitting of a tubular column of air, as produced by the musician's blowing of air into the mouthpiece. Lip plate 295 fits into the space between the chin and the lower lip, and contours into the curvature of the face. The contouring curvature of the lip plate allows it to snug into a stable position with respect to the player's face.

In one embodiment, the present invention uses microphones unconventionally as signal amplitude sensors. Whereas microphones conventionally act as converters from acoustic sound to an electronic audio signal, in the present invention the microphones perform the unconventional function of signal amplitude sensors, and do so by responding to the friction noise from the blowing of air directly onto the microphone surface. Friction noise is a by-product of strong fluctuations of air molecules moving in and out of the microphone which causes the microphone to overload and to generate noise instead of passively representing sound in the acoustic environment. The present invention uses this phenomenon at very low gain levels of operability of the microphone, where the noise does not produce distortion in the signal. At the higher gain levels normally needed to record acoustic sound, the noise causes microphone overload and distortion in the signal. Overload and distortion is what recording engineers especially attempt to avoid in the conventional use of the microphones.

Figure 3A:
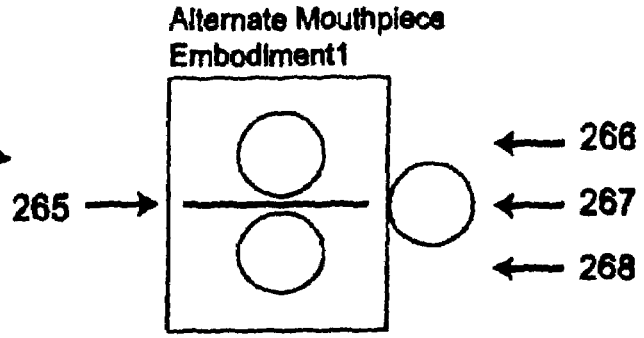
FIGS. 3A, 3B and 3C are schematic illustrations of alternative embodiments of the mouth pieces of the present invention.
Figure 3B:
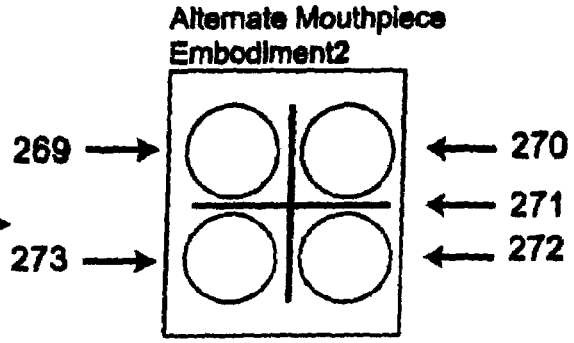
Figure 3C:
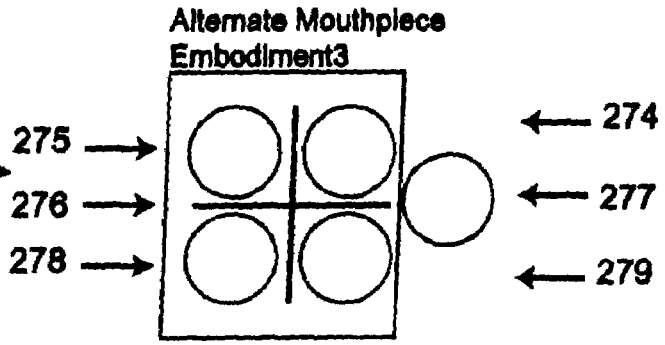

FIGS. 3A-3C schematically depict alternative mouthpiece embodiments. The alternative embodiment in FIG. 3A includes a wind separator 265, an outside microphone 266, an inside microphone 268 and an additional microphone 267 which is set in the mouthpiece away from direct contact with the air column produced by the player. Microphone 267 is used conventionally to amplify the player's breath sound, distinct from the friction detection on the microphone surfaces, and to use it in the application as an audio signal. The sound source can further be integrated into the synthesis procedures or alternatively analyzed for timbre differences which in turn become additional controllers. In the second instance, "timbre differences" means bandwidth changes in the frequency spectrum of the breath noise. (For example, "sssss" has a higher frequency content than "fffff.")

A non-limiting example of frequency tracking techniques in generating control data is as follows. The breath sound is routed through a filter on the computer. The filter routes the breath sound through specified bandwidth channels (i.e. Low, Middle and High). The breath will either be complex enough, or not, in its frequency spectrum, such that sound will pass through any or all three channels. Typically there will be some signal at all three bandwidths, but the amplitudes of those signals can be quite different. The amplitude can be measured and calculated. Threshold triggers can be introduced so that a toggle is turned on when the amplitude exceeds a specified value.

The alternative embodiment in FIG. 3B includes a cross-wind separator 271, a left outside microphone 269, a right outside microphone 270, a left inside microphone 273, and a right inside microphone 272. This embodiment expands the number of unconventionally employed microphones to four microphones 269, 270, 272, 273, while at the same time allowing for different porting and analysis of the input data streams.

The alternative embodiment in FIG. 3C includes a cross-wind separator 276, a left outside microphone 275, a right outside microphone 274, a left inside microphone 278, a right inside microphone 279 and an additional microphone 277 which is set in the mouthpiece away from direct contact with the air column produced by the player. This embodiment also expands the number of unconventionally employed microphones to four microphones 274, 275, 278, 279. Microphone 277 is used conventionally, namely, to port the player's breath sound—distinct from the friction action on the microphone surfaces—and to use it in the application as an audio signal.

It will be apparent to those skilled in the art that various changes and modifications can be made without departing from the spirit and scope of the present invention. Without being limiting, such modifications can include: a variation in the array, number, type, detection input and amplifying of microphones or other signal amplitude sensors; and a variation in the number and placement of wind separators.

Referring to FIGS. 4 A-C, it will be further appreciated by those of skill in the art that a number of characteristics interplay in the design of the microphones or other signal amplitude sensors. Without being limiting, such design concepts center on: housing for the microphones (open or closed); ergonomic microphone principles; maximization of performance efficiency; and comfort of the player. As a non-limiting examples, performance efficiency considerations in the development of one embodiment of the invention include: 1) mounting and proximity positioning of microphones 205 and 215 in relation to each other and to the mouth; 2) placement of a wind separator 210 such as to control the splitting of the air column in terms of distance; 3) designing a lip plate 295 capable of providing a stable physical reference point for the player, such that consistent movements and performance practices can be developed.

FIG. 4B depicts a first version of the mouthpiece, constructed on a hypothesis that because the player is always angling the instrument differently, the microphones should be set at different distances from the mouth. This version comprises a lip plate 290 and a wind separator 291 on which are mounted an inside microphone 205 and an outside microphone 215. Because of the player's tendencies and performance bias, it may be more difficult to direct air to one microphone than another, and to blow air more downward than across the microphone surface. A solution was sought by moving the disadvantaged microphone 215 closer to the mouth than the advantaged microphone 205, and by minimizing the lip plate 290 by making it narrow and curved away from the face such as to give the player more license in how to move it while playing. The wind separator 291 was angled anticipating a tendency to blow down rather than perpendicular to the face. This version was found to allow the player too much license, and therefore other constraints were further sought to be developed in order to discipline the playing technique.

FIG. 4C depicts a second version of the mouthpiece. This version comprises a lip plate 293 and a wind separator 292 on which are mounted an inside microphone 205 and an outside microphone 215. This version, which utilizes some of the shakuhachi mouthpiece design features, adds a greater mass to the lip plate 293 to allow a better feel of the plate against the lip and to enable better manipulation. Additionally, this provides physical familiarity for shakuhachi players. A speculation driving this version is that the microphones should be segregated (due to the possibility of acoustic bleed independent from friction bleed). The wind separator 292 performs a double function as it splits the wind produced by the player and acts as an outer wall that segregates the inner microphone 205. Thus, in addition to a separator, a shakuhachi like container wall 292 is part of this version. Advantageously, in the versions of FIGS. 4B and 4C, the distance of the two microphones to the mouth can be adjusted by the player to suit his/her playing style. The greater constraint of the version of FIG. 4C still creates an experience of one microphone being more difficult to excite. Contributing variables to this disadvantage could include, without limitation: inequality of microphone gains, a software application defect viz-a-viz loss of gain or control efficacy, and establishment of a player's practice routine that achieves hearing and actively responding to different versions of the software application. A development trend of this version is towards producing a greater constraint in the mouthpiece, on the one hand, and towards novel design solutions that bear less resemblance to any acoustic flute paradigms.

FIG. 4A schematically represents a preferred mouthpiece version which returns to an open housing. This version comprises a lip plate 295 and a wind separator 210 having first and second major surfaces on which are mounted an inside microphone 205 and an outside microphone 215. Also shown are inner tube 296, outer tube 298 and stabilizer 297. In this version, problems of acoustic bleed are resolved, as the gain levels of the microphones 205 and 215 are very low. In this version the microphones 205 and 215 are placed at the same distance from the mouth and angled more in towards the face; that is, they are angled such that the microphone surfaces face the player's face more directly. This enables equal response of the two microphones, and permits a relaxed close-to-the-body posture. The separator plate 210 extends further than before above the microphones 205 and 215. The distance of the leading edge of the separator plate from the lips is important: it can't touch the lips but should be close enough so that the player has some small measure of physical awareness of it. The equal distance of the microphones 205 and 215 eliminates overcompensating and allows the player to assume equal response. As previously determined, much of the disparity in microphone response is in part attributable to the habit of putting a greater percentage of the air column into the instrument than out resulting in the outside microphone consistently receiving less air.

As shown in FIG. 4A, the microphones are angled such that they face the player's face more directly. Thus, the player's breath on average hits the two microphone surfaces more equitably. This eliminates any requirement that the instrument be held farther out from the player's body, which can be fatiguing as was the case in earlier versions of the mouthpiece. To accommodate this playing position, the lip plate 295 rests lower on the face fitting between the chin and the bottom lip (instead of resting solely on the bottom lip), thus allowing the player more stability, stillness and efficiency, while allowing the player to still make all normal movements with the jaw and the lips. At the same time, the player can deviate from a more stable normative technique, if desired.

FIG. 5B is an enlarged side view of finger track pads 225, 230, 235, 240, 245 and finger holes 255, 256, 257. Finger track pads sense the proximity of a finger to an electromagnetically sensitive surface. The dimensions of each pad are approximately $1\frac{1}{16}^{th}$ inch by $1\frac{9}{32}^{nd}$ inch. The pads used here sense this proximity in three dimensions. The finger holes are used to support the instrument. In an alternative embodiment of the invention, fingering sensors may be used in lieu of finger track pads. The fingering sensors consist of a configuration of three or more one-dimensional proximity sensors set into a metal ring, itself set on top of a pressure sensor. In this version there are at least four continuous controllers. An advantage of obtaining additional control has to be weighed against finger sensitivity limitations. A general limitation of fingering sensors compared to finger trace pads is that they are more unwieldy, heavier and more difficult to maintain.

FIG. 5A shows a preferred placement of the left index and ring fingers and right index and ring fingers on track pads 230, 235, 240, 245, respectively. Illustratively, the top outside hole 255 is used by a left hand finger; the top inside hole 256 is used by the right hand thumb; the bottom hole 257 is used by the right little finger. A single finger (e.g. the right little finger) inserted in the bottom finger hole 257 bears the main weight of the instrument.

Each of the five finger track pads produce three continuous controls: X, Y and Z parameters. The positions of the finger on the finger track pad are: X—up and down, Y—sideways, left to right. Both X and Y controls have high resolution, producing a stream of numbers from 0 to 6000 depending on the X and Y position of the thumb or finger on the track pad. The Z parameter measures the percentage of the finger track pad area covered. It is effectively a pressure sensor because the player needs to press harder to cover greater area. The Z control has a lower resolution producing a stream of numbers in the range from 0 to 256 depending on the percentage of the pad that is covered. The finger track pads are set so that the tendency is to use the index and ring fingers. The thumb pad is normally used by the left hand. There is no thumb pad for the right hand. The right thumb and little finger are used to hold and stabilize the instrument.

Finger track pad mounts 222, 223, 224 enable the player to access the entirety of the finger track pad. The mounts are customized milled mounts that are cut to allow the edges and sides of the track pads to be completely available to touch. The milled mounts are aluminum pads custom shaped to secure the entire surface of the finger track pad and make it available for the largest range of possible finger actions. Specialty cables (not shown) connect with the finger trace pad at a 90 degree angle allowing the cable to be routed directly into the body of the instrument.

It is a further object of the present invention to provide an ergonomic design for flute controller driven dynamic synthesis system 100. Among others, several preliminary guiding principles include the need: to exert as little physical effort as possible; to optimize the efficacy of the physical gestures involved in performing, and to provide a look that is aesthetically pleasing to the senses.

EXAMPLE

In this example, the flute controller's performance gestures are modeled on the shakuhachi flute. These gestures are distinguished by breath technique and fingering technique. The breath technique on the shakuhachi directs the wind forward and backwards, and to either side as well. It thereby introduces a wide range of timbre differences into the tone production. The technique of the transverse silver flute by contrast is inspired by a "bel canto" (beautiful voice) model of tone production, and the technique aspires to keep the wind direction very stable, thereby not introducing sudden timbre shifts into the tone production. The flute controller of the present invention is conceived as a timbre oriented instrument for which the shakuhachi model provides a greater appeal.

EXAMPLE

In this example, the flute controller's body is also modeled on the shakuhachi flute. The single most important feature of the shakuhachi body for ergonomic considerations is that it is a vertical flute, not a transverse flute. The body symmetry demonstrated in holding a vertical flute is less fatiguing than the left-to-right asymmetry demonstrated in holding a transverse flute. Verticality is the first principle.

It can be appreciated by those of skill in the art that even ostensibly small differences in the physical requirements in holding and manipulating an instrument can become very significant fatigue factors when one considers the hours of activity the musician devotes to practicing. A condition for virtuosity on an instrument is facility at a micro-gestural level (e.g., the single finger shadings over the finger hole that a shakuhachi player executes all the time are invisible to the audience member, but sonically very important to the "vitality" of the sound). In a sense, the musical player is like an engineer, constantly finding ways to ease and disperse load requirements, often by dynamically shifting and transferring the burden of that load.

Like most acoustic models, the shakuhachi has some ergonomic drawbacks as well as assets. Even though on average the shakuhachi is not very heavy (1 to 1.5 lbs), a part of the technical problem is holding the instrument. The right hand can never loose its grip or else the instrument would fall. Ideally, the fingers which are operating the finger track pads should be entirely free from any such structural task. It detracts from what the finger can do on a finger track pad if it has to share in the task of carrying the instrument weight as well. Ostensibly, the index and ring fingers operate the finger track pads, but there are circumstances where it is optimal to extend the technique so that the middle and little fingers can operate the finger track pads as well. The left thumb is occupied always with its own finger track pad. By default that means that the right thumb is the remaining digit whose primary task is carrying the weight of the instrument. However, with this ergonomic design, when the thumb is overworked, the fatigue has negative consequences for other parts of the hand, and performance is compromised.

EXAMPLE

It is an object of the present invention to provide options for carrying the instrument weight, including, but not limited to, stress release options, and means for distributing and transferring the load. This invention considers the use of the little fingers for the task of holding the instrument. They are the least dexterous on the finger track pads, and are almost always available. Therefore, in one embodiment three digit holes are present: for the left little finger, right thumb and right little finger. As can be appreciated by one of skill in the art, other comparable digit and digit hole positions are also within the spirit and scope of the present invention. The present paradigm allows the player to shift the load, to "address" the finger track pads with the fingers from different angles, and to create additional musical performance options. For example, when taking the instrument weight with the right thumb, it is easier to roll the fingers onto the finger track pads, especially from the right side. When taking the instrument weight with the right little finger, it is easier for the other fingers to come down directly on top of the finger track pads. Staccato (short and sudden) type gestures are easier with this type of support.

EXAMPLE

As a non-limiting example, the present invention includes the use of neck straps, such as those used by saxophone players, as a means for bearing weight, for setting the proper relationship of control of the instrument to the body, and for introducing simplicity into the design concept.

EXAMPLE

The shakuhachi may serve as a weight solution paradigm. Few instruments are as ostensibly as simple as the shakuhachi—a single un-mechanized bamboo tube. At the same time, few instruments are as subtle and complex in their crafting as the shakuhachi. Furthermore, it is possible to solve the weight problems with the right choice of light materials, then the neck strap loses its advantage as a solution for bearing weight. Weight is only one of the criteria for selecting the material for the body. The body material would also have to be capable of housing wiring and electronic circuitry in a way that remains invisible and thus unobtrusive as far as the player is concerned. The material would also have to be malleable. It would also have to answer aesthetic requirements, i.e. "invisibility" within the sense of discerning the musical apparatus primarily through the micro-physical gestures of the player.

Non-limiting examples of materials that have been explored include cast resin, plexiglass and plastic assemblages. These materials generally fit the need for malleability, while at the same time equating "invisibility" with transparency. However, they are generally also negatively associated with certain structural defects. Resins tend to be brittle, especially for use on heavy loads. Plastic assemblages do not lend themselves easily to designs with complex curves, unless they are cast, in which case they present the above load issue.

EXAMPLE

By redefining "invisibility" as minimum volume visible from the front (the predominant playing position relative to an audience), the invention disclosed herein opens up the possibilities for use of other materials. In a preferred embodiment of the invention, rosewood and aluminum tubing are used. Rosewood is easily milled in three dimensions, which adds simplicity to making the housing for wiring and other electronics. It is also very light and robust. It can bear significant load when cut and shaped strategically with respect to load. Aluminum is very light: also, aluminum tubing offers a useful cable transporting function. Together, the rosewood and aluminum tubing materials have a well-crafted look which combines traditional with high tech appearance.

EXAMPLE

A first attempt to mount the finger track pads set the left hand finger track pads at a left tilted angle, and the right hand finger track pads at a right tilted angle, and situated this in a foam board body. This set-up turned out to be an over determination which does not account for how adaptable and flexible the wrist is. If the finger track pads are mounted at one angle only, both wrists can easily accommodate the change and adapt. This experiment clarifies that the solution to many ergonomic problems rests with the player and his ability to quickly adapt his body to unpredictable performance situations. A working hypothesis is premised on the idea that if there is no perfect posture for the elbows-wrist-hand-finger combination, then a player would expect to develop a performance practice most easily when the "mechanics" of the instrument are simplified. Accordingly, in one embodiment the finger track pads were mounted uniformly such that each finger track pad would be addressed by a finger in the same way. However, while the foam board embodiment enabled assembly of the components in preliminary ways, it was not sufficiently robust and quickly deteriorated. Furthermore, a limitation arose from the inset. On the foam board version the finger track pads had been inset, such that the edges of the finger track pad were slightly covered, and such that the finger track pad was slightly depressed. The transition for the finger from the side of the finger track pad lacked smoothness, and created jumps in data as a result, whenever an action on the edge of the finger track pad was executed.

EXAMPLE

Another embodiment employs the use of plastic hardware. The first impetus behind the plastic embodiment was to create an instrument that was robust enough for performance. The plastic embodiment positioned the finger track pads top mounted flush with the body surface, and therefore enabled smooth performance actions from the edges of the finger track pads. As a downside, this version was much heavier than the previously described versions.

EXAMPLE

The accomplishments of the two early embodiments pertained largely to the finger track pads. Another embodiment of the invention further optimized the finger action of the finger track pads. Aluminum milled finger track pads mounts 222, 223, 224 were made that suspended the finger track pad slightly above the body (FIG. 5B). As a result, rolling actions with the fingers from the side can be executed with even greater precision. The finger track pads are responsive to the proximity (close, but not touching) of the finger as well as direct touch. Above-suspended finger track pads therefore also further enable this highly subtle control feature, as proximity can be executed from the sides as well as above the finger track pad.

EXAMPLE

In one embodiment, ergonomic developments of the mouthpiece are considered. With respect to the mouthpiece, some problems to be solved related to: the mounting of the mouthpiece at the top of the instrument; the shape of the neck; and the type of tubing material. As a non-limiting example, aluminum tubing is preferred because this metal is very light and allows a hidden passage for the microphone cables. Advantageously, the neck is also made adjustable. This serves a dual purpose: folding to facilitate transportation and packing; and allowing some minute adjustments in how the player holds the instrument. The latter is determined by the posture habits of the player, and by their comfort level with angling the instrument body towards or parallel with their own.

EXAMPLE

Important ergonomic considerations further relate to the outer appearance of the flute controller. The look of present-day electronic musical instrument systems tends to be either dominated by racks of gear, or by indefinite complexities of nuts, bolts, cables and boxes. In contrast, the present invention sought a look which is highly compact and simple in appearance. In a most preferred embodiment, this requirement is accomplished by the use of wireless technology. This simultaneously satisfies the criteria of aesthetics, ergonomics, and higher degree of mobility of the player in performance space. However, limitations as to transmission range and proximity to loudspeakers may result. In this respect, playing directly in front of a loudspeaker tends to create data feedback. If the room sound is loud enough, the microphone tends to detect sound even at low gains. In this context, data feedback is undesirable, as it takes control away from the player.

Figure 6A:
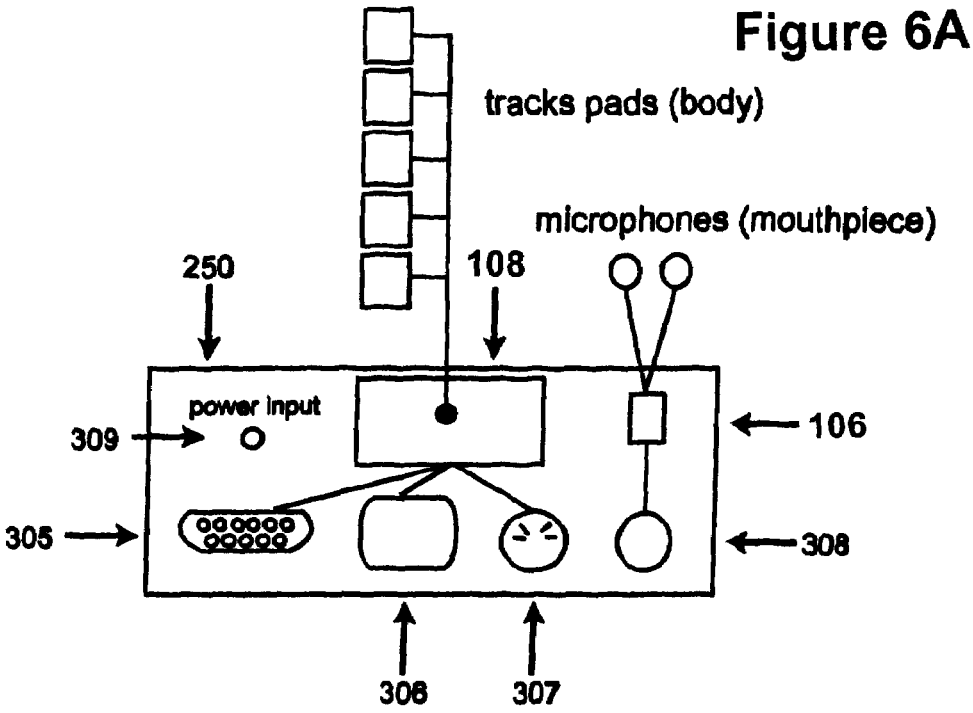
FIGS. 6A and 6B are schematic illustrations of alternative circuit boards of the controller of the present invention.

FIG. 6A is a schematic representation of the contents of circuit board enclosure 250. Mounted on a circuit board are a microprocessor 108, a serial I/O port 305, a visual output 306, a finger track pad MIDI data port 307, an audio signal port 308, and an amplifier 106. The circuit board is powered externally via power input 309.

Illustratively, the microprocessor is programmed in BASIC or C++ to convert track pad data into MIDI protocol. The microprocessor 106 sends data using the MIDI protocol through port 307 by way of a standard 5-pin MIDI cable. More specifically, microprocessor 106 converts the electromagnetic data generated by moving the fingers over the surface of the finger track pads into high resolution data that can be transmitted using the MIDI protocol. Illustratively, parameter or axis X and parameter or axis Y each has a resolution in terms of a range of 0-6000 and parameter or surface percentage Z has a resolution in terms of a range of 0-256. Each finger track pad generates these three data streams. Therefore the microprocessor 106 sends continuous control signal data for three continuous controllers for each of the five finger track pads 225, 230, 235, 240, 245, resulting in fifteen continuous streams of control signal data in all. Without being limited, the processing of the control data also includes: monitoring for when only zeroes are being produced (when no finger is on the finger track pad) and not sending redundant values; and enabling diagnostics on the finger track pads; and enabling a visual report to be used in such diagnostics.

Amplifier 108 is a first stage of amplification of the microphone transducer signal. It supplies the minimal amount of voltage needed to push the signal to its destination in the Firewire interface 115. The amplifier output is provided to audio signal port 308. Audio signal port 308 is a standard mini cable plug at the controller contact point, and a standard ¼ inch plug at the Firewire interface 115 point of contact.

Serial I/O port 305 may be used for example as a diagnostic and development tool to help locate the source of malfunctioning of a finger track pad (i.e., the chip, the cable connections or the finger track pad itself). Visual output 306 is used by the same application as a diagnostic and development tool, such as for instance to provide a report for diagnostic purposes.

The embodiment of FIG. 6A is a tethered version with connections to a power input cable and signal cables that connect the instrument to the MIDI interface and Firewire audio interface. The tethered version achieves ergonomic facility which does not overly fatigue the right little finger. In one embodiment of the tethered version the instrument may weigh two pounds.

Figure 6B:
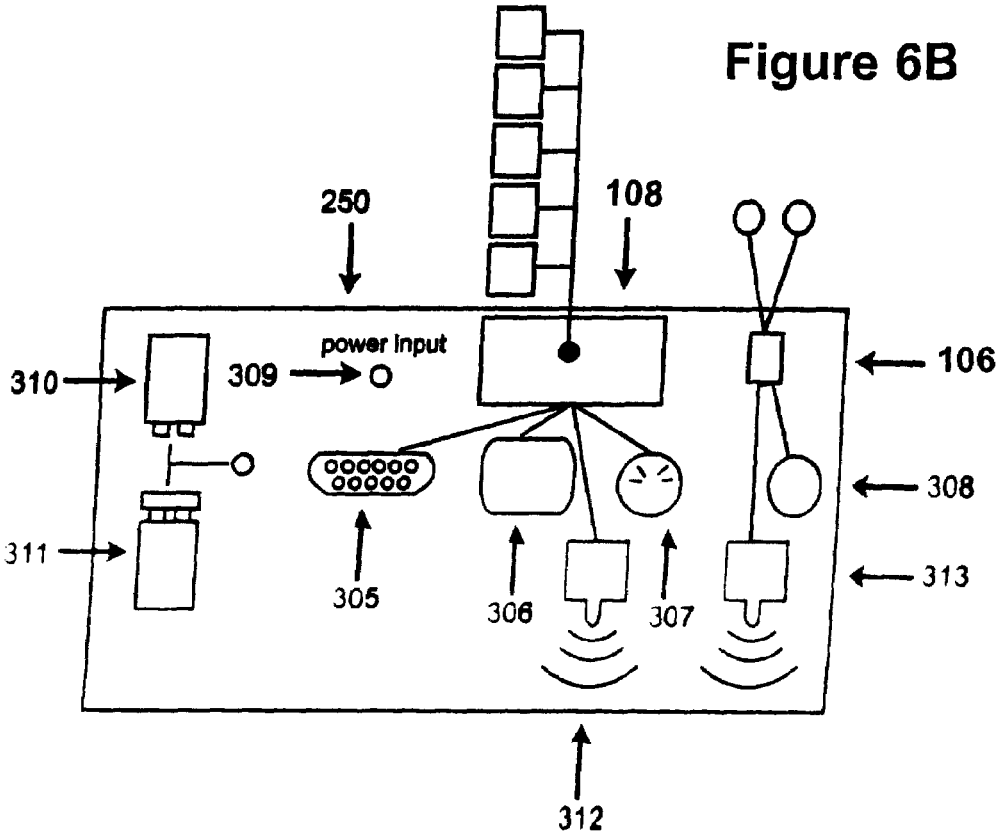

FIG. 6B is a blown-up schematic representation of an alternative wireless embodiment of the device of FIG. 6A. It contains the same elements as the embodiment of FIG. 6A and, in addition, includes a main rechargeable battery 311, a back-up battery 310, a wireless transmitter 312 for the finger track pad data, and an audio signal transmitter 313.

Wireless technology can be implemented, without any limitation, by using Bluetooth or other comparable wireless technology for control data, and where applicable, other wireless transmission technology for audio data. Without being limited, criteria for choice of transmitter 312 center on the ability to program the transmitter 312 with respect to transmission frequency.

It is another object of the present invention to provide a means of dynamic control which achieves standards bearing the sound complexity of acoustic flutes. To this end, fingering events detected by the track pads 225, 230, 235, 240, 245 and blowing events detected by the microphones 205, 215 are used to control a plurality of signal synthesizers that are used to generate sound.

Figure 7:
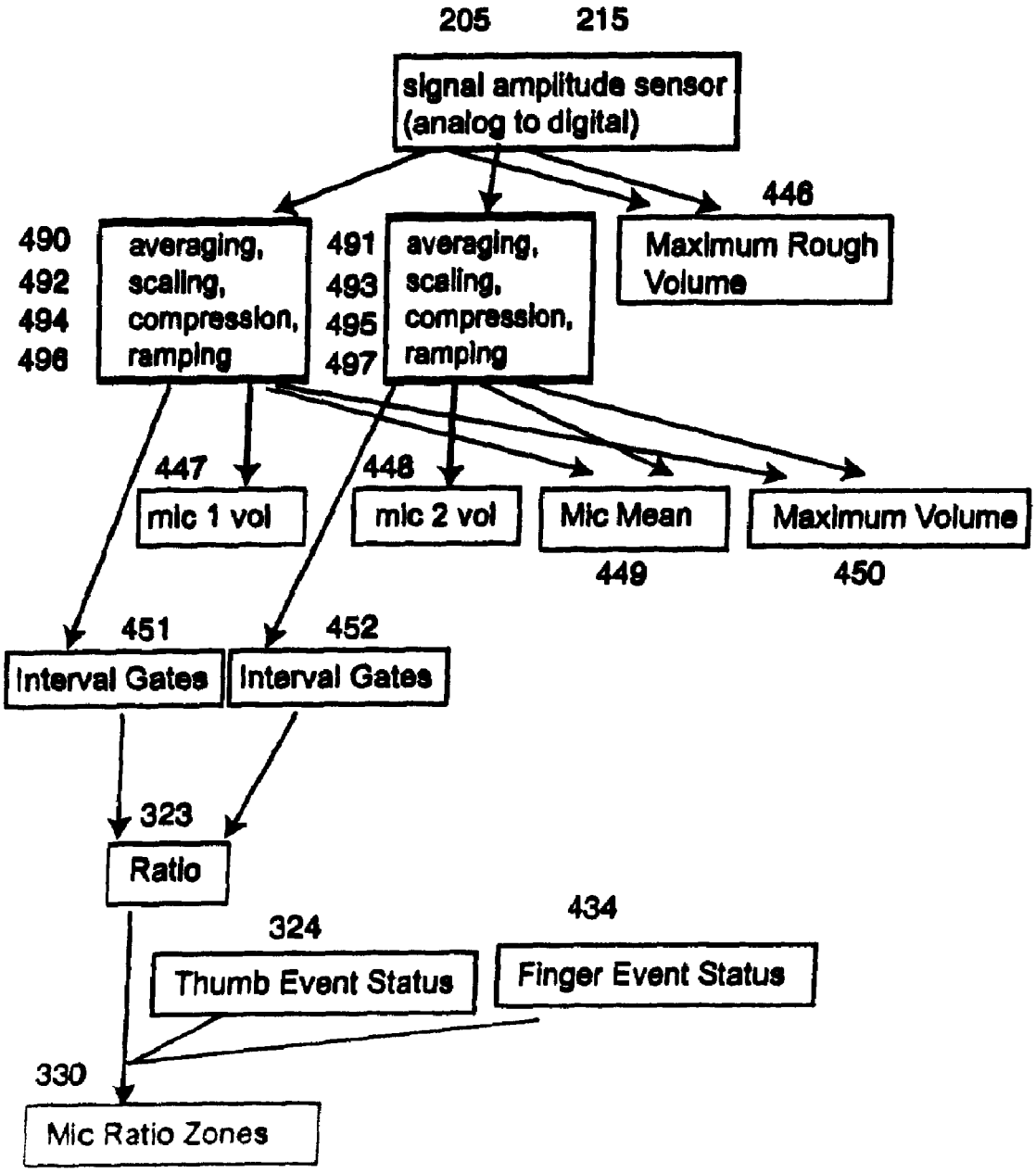
FIG. 7 is a flowchart depicting processing of breath events.

The processing of the breath events received from microphones 205, 215 is depicted in the flowchart of FIG. 7. The two signals from the microphones are first converted from analog (A) signals into digital signals (D). The A to D conversion provides only a raw 'material.' Although it reveals the general shape of the control source (the player's breath tendencies), the raw data is jittery and too 'noisy' for musical purposes.

There are several techniques that can be used to 'massage' the individual microphone data such that it becomes manageable musically including averaging, scaling, compression and ramping. They all have advantages and disadvantages, and so the solution to musical ends has to come through a combination and careful negotiation between such individual strategies. Averaging the data reduces the resolution and slows and reduces the bumpiness, but depending on the averaging sample size, possibly at the expense of quickness of response. Scaling contracts, expands or transposes the control data. Depending on where the data is being sent, different types of numbers may be used (natural integers or floats). Compression assures that there will be no numbers higher or lower than a desired bandwidth and protects the routine from being overloaded with an excessive value. Ramping is enormously useful in filling in the spaces (the larger intervals) of jittery data. However if the data is being received at a rate that is faster than the ramping rate, it does not help. Averaging in conjunction with ramping is very useful in achieving the aims of smoothness but not at the expense of a slow response. In addition to this, interval gating is another effective technique. Such a routine specifies an interval threshold. Any registered interval (jump in the data) greater than the specified threshold interval, results in a filtering out of the values that produce the jump. This technique has the one disadvantage in that one extreme value always makes it through the filter before the filter is activated. In other words, it is still a statistical technique and as such always falls a little behind the fact. But again, when used in conjunction with averaging and ramping, the danger of sudden large peaks in the received data is removed and the smaller peaks that find their way into the control stream are not large enough to be a problem; they are tolerable.

The control destination is important in determining what type of manipulation the original data needs. As a general rule, if the control destination directly affects an audio signal, it is important to achieve both smoothness and quick response.

Another consideration is the amount of delay that inevitably results from such routines. Delays of up to 100 milliseconds are tolerable from a musical time standpoint, and musical time is the criterion here.

Accordingly, the processing of the digital signals from the two microphones includes the steps of averaging 490-491, scaling 492-493, compression 494-495 and ramping 496-497 to generate tolerable basic amplitude streams. These streams are provided to outputs 447 or 448, interval gates 451 or 452, and to outputs 449 and 450. The two digital signals are also analyzed at step 446 to determine the maximum value of the raw microphone data streams. Averaging, scaling, compression or ramping is not needed in this case because the output of step 446 is only used to control a gate. If the output is above a threshold, a gate is opened, and if below, the gate is closed. It can be appreciated by those of skill in the art that sometimes the individual microphone data is pertinent as in outputs 447 and 448; and sometimes only the average of the two streams or the maximum of the two streams is of interest as at outputs 449 and 450. Interval gates 451 and 452 are employed to aid in stabilizing the routine which determines at step 323 the ratio of amplitude between the two microphones. This routine needs to achieve as much stability as possible because it is used in changing the microphone ratio zone 330, which in turn changes the basic fingering values 331 described in FIG. 8 below. In a preferred embodiment of the invention, the microphone ratio zone 330 has one of the values 1, 2 and 3.

As schematically depicted in FIG. 7, the generation of a microphone ratio zone is initiated by a signal representing status of a thumb event 324 or a finger event 434. The generation of these signals is described in conjunction with FIG. 8. This is another example of how the microphone data and the finger track pad data interact.

Figure 8:
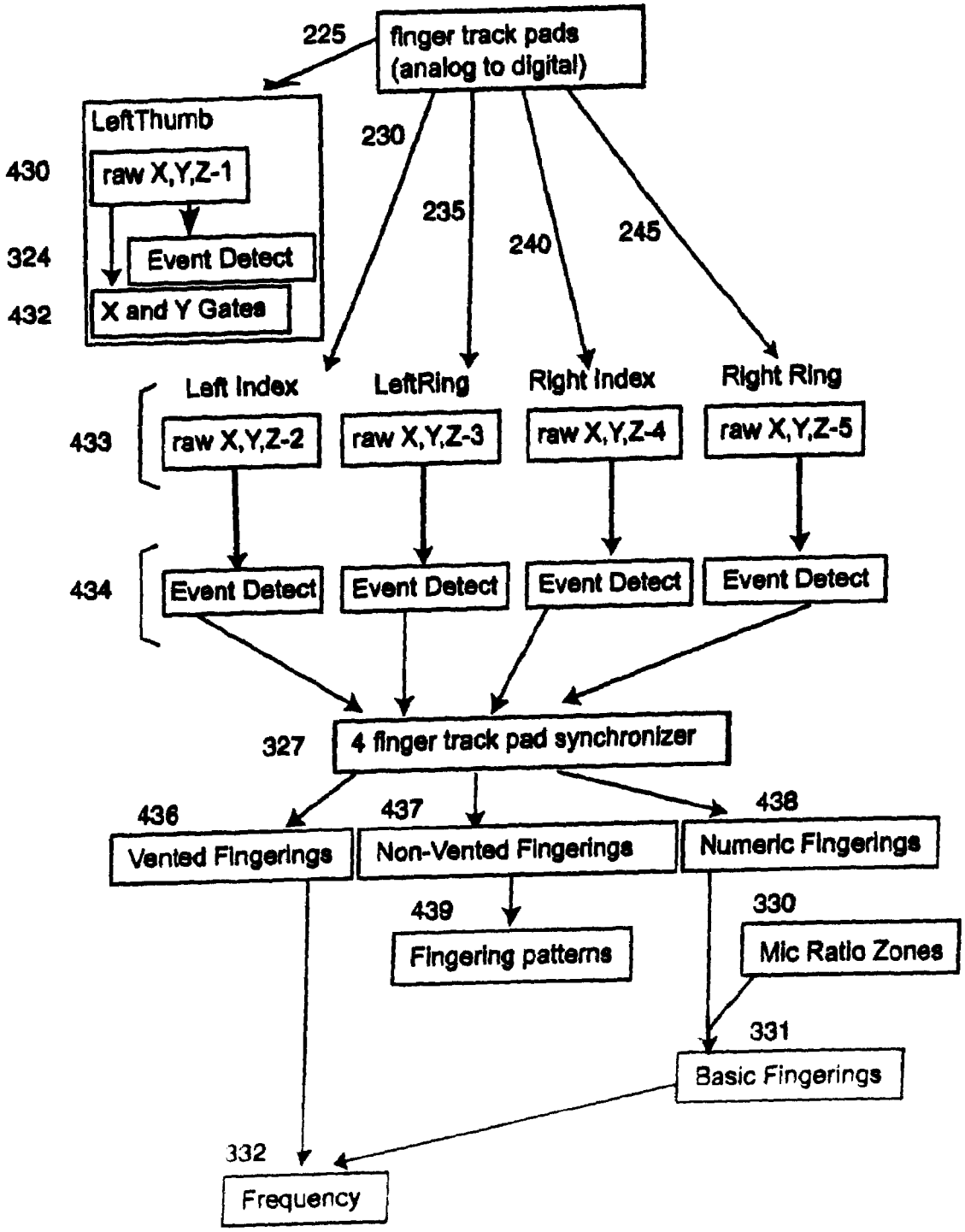
FIG. 8 is a flowchart depicting processing of fingering events.

The flowchart of FIG. 8 depicts the processing of fingering events received from track pads 225, 230, 235, 240, 245 into a variety of control types including continuous controls, threshold triggers and toggles, discrete combinatorial controls, event sequence controls and interpolated controls. The invention includes reading from all continuous controllers with respect to their on or off state. Event detect step 324 indicates a routine where the three continuous controllers manipulated by the left thumb are read with respect to their on or off states. A reading of "0" is off; a reading of greater than "0" is on. Similar event detect steps 434 are executed for the other track pads.

Ideally, an on/off reading from only one of the three parameters (X, Y or Z) would be sufficient to determine whether the finger is on or off the finger track pad. But as the finger track pads have response idiosyncrasies, it is an object of the present invention to present a routine where all three parameters are combined to make this on/off determination. There are several reasons why relying on only one parameter may not indicate that the finger has left the finger track pad. Depending on how the microprocessor on the flute controller is programmed, there may occasionally be "hanging" values which persist after the finger has left the finger track pad. This may also be due to idiosyncrasies of the finger track pads themselves. The finger track pad's sensitivity differs towards the edge of the finger track pad; and there is less predictability at the numerical limits of all three controllers. A solution is found in the player adopting the appropriate performance practice sensitivity. There are instances when the finger track pads demonstrate proximity sensitivity, such that they generate data when the finger hovers close to them, but does not make direct contact. The flute controller player may, following practice, become flexible and capable of quick adjustment in order to take advantage of this sensitivity approach. As a further non-limiting solution, redundancy is introduced into the event detection routine to guarantee that none of these other factors influence the on/off toggle function.

The data from the four finger track pads is provided to a four finger track pad synchronizer 327. Synchronizer 327 provides discrete combinatorial control, which is possible on the basis of such rudimentary event detection, and through combination and synchronization of the four finger track pads. The combination of the event states of the four finger track pads yields a fingering output that specifies a configuration of the finger track pad states. This is a new control level based on the simple event detections of the individual finger track pads. It is discrete (step wise or incremental) as opposed to continuous (no discernable steps or increments between states). In one embodiment of the invention the thumb is not included in the fingerings as it serves several other specialized functions. The fingering output includes vented fingerings 436, non-vented fingerings 437, numeric fingerings 438, fingering patterns 439, and basic fingerings 331.

It is conventional to differentiate between "vented" and "non-vented" fingerings on a woodwind instrument. Vented fingerings 436 introduce "gaps" in the length of the fingered tube. On the flute controller there are 11 such vented fingerings. When implemented they have the specific function of changing specific waveforms that are used in the complex FM synthesizer 359 described below in conjunction with FIG. 11. Non-vented fingerings are closed from the top of the instrument progressively towards the bottom. Accordingly, on the flute controller which is using four finger track pads for the fingerings, there are four non-vented fingerings, not including all fingers off.

Fingering patterns 439 is a discrete control derived from non-vented fingerings 437. The fingering pattern routine simply tracks sequences of non-vented fingering iterations. It is optionally implemented in selecting and implementing presets, which belong to a set of pre-determined signal routing configurations of what is "mixed" (FIG. 10).

Numeric fingerings 438 (the determination of how many fingers [1, 2, 3 or 4] are on keys, whether vented or not) are available on the flute controller, but are redundant on an acoustic woodwind instrument. A feature of control data relied upon in one embodiment of this invention relies upon abstracting from the redundancy and assigning a specific functionality. In this application, the four possible values of numeric fingerings 438 are combined with the three possible values derived from the microphone ratio zone 330 of FIG. 7 to produce 12 (=3×4) basic fingerings enumerated from 1 to 12. For example, 'mic ratio zone' 330 will always be a value of 1, 2 or 3, and 'numeric fingerings' 328 will always be a value of 1, 2, 3 or 4. If a mic ratio zone of 1 is combined with numeric fingerings, then a basic fingering 331 results that is the same as the numeric fingering 1 to 4; if a mic ratio zone of 2 is combined with numeric fingerings, then a basic fingering 331 results that maps numeric fingerings 1 to 4 onto 5 to 8; and if a mic ratio zone of 3 is combined with numeric fingerings, then a basic fingering 331 results that maps numeric fingerings 1 to 4 onto 9 to 12. This is somewhat analogous to octave thresholds on a flute: by increasing the wind speed on a flute, the fundamental frequency shifts upwards in multiples of two. Hence a flutist can play in three octaves. The threshold shift is achieved differently here, but the practical result is the same: the achievement of pitch (or note) classes shifted upwards by a consistent multiple yielding a greater number of pitch instances of the class.

Figure 10:
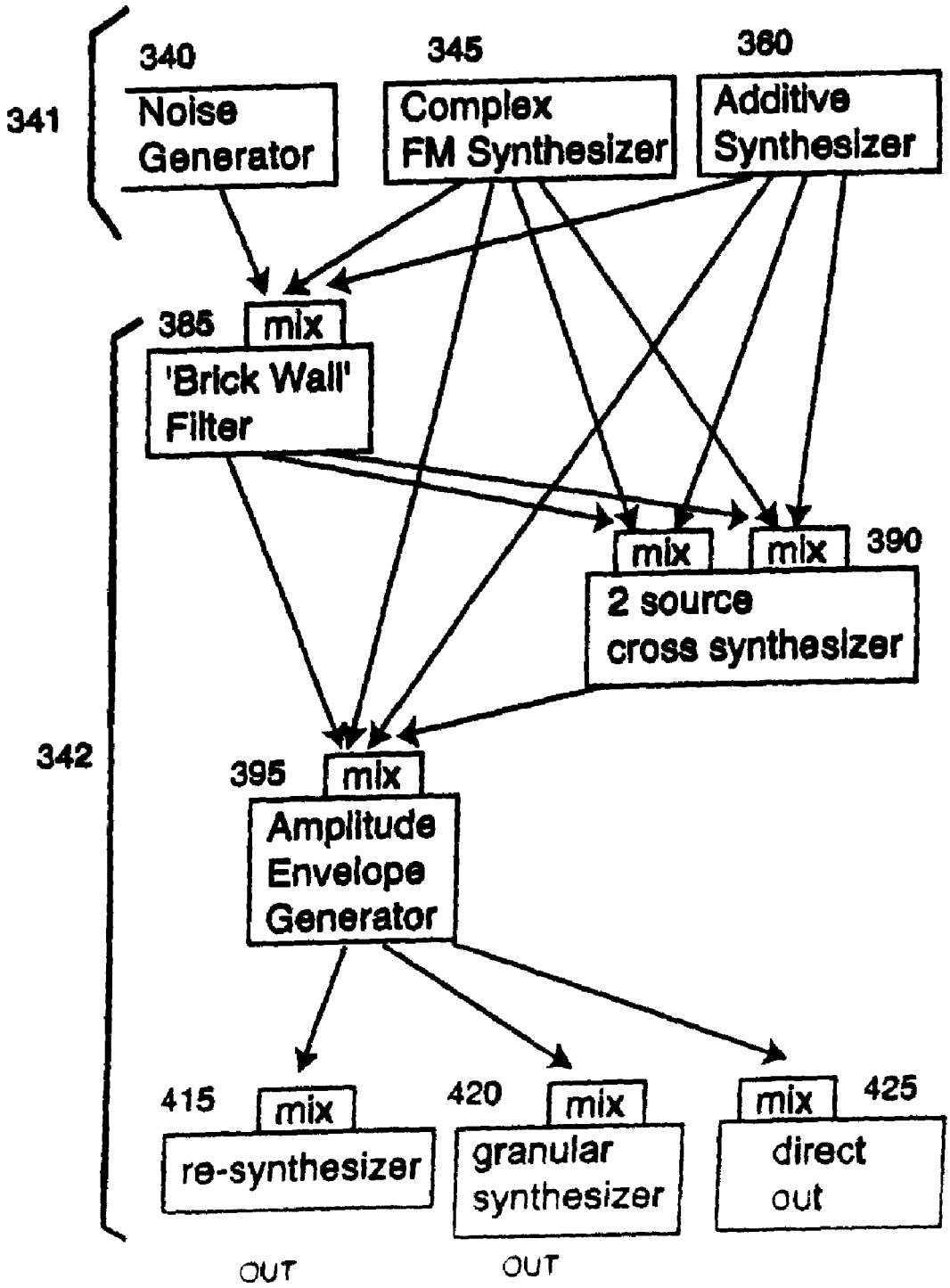
FIG. 10 is a flowchart depicting the organization of the signal synthesizers of a first embodiment of the invention.

The "basic fingerings" output 331 is used in the re-synthesizer 415 of FIG. 10 where the fingerings map onto a corresponding set of specifications identifying data bin combinations. The data bins are the components in the spectral analysis of the audio signal. This is how frequencies are selected out of the frequency spectrum. It is an object of the present invention to provide a re-synthesis "signature" change routine operable to achieve a gradual change in timbre. In one instance, such "signature" change routine can occur when the player plays basic notes from low to high. Functionally, this routine change is analogous to an acoustic instrument's color changing when it moves from its low to its high register.

Frequency 332 indicates the assigning of frequency values to note designations, much like determining the pitch frequency of solfage (do, re, mi, etc.) designations, e.g., to determine that 'la' is 440 Hz. Control recipients of this data usually require only a note designation (1-12). Synthesis recipients require frequency values in order to generate audio signals.

Figure 9:
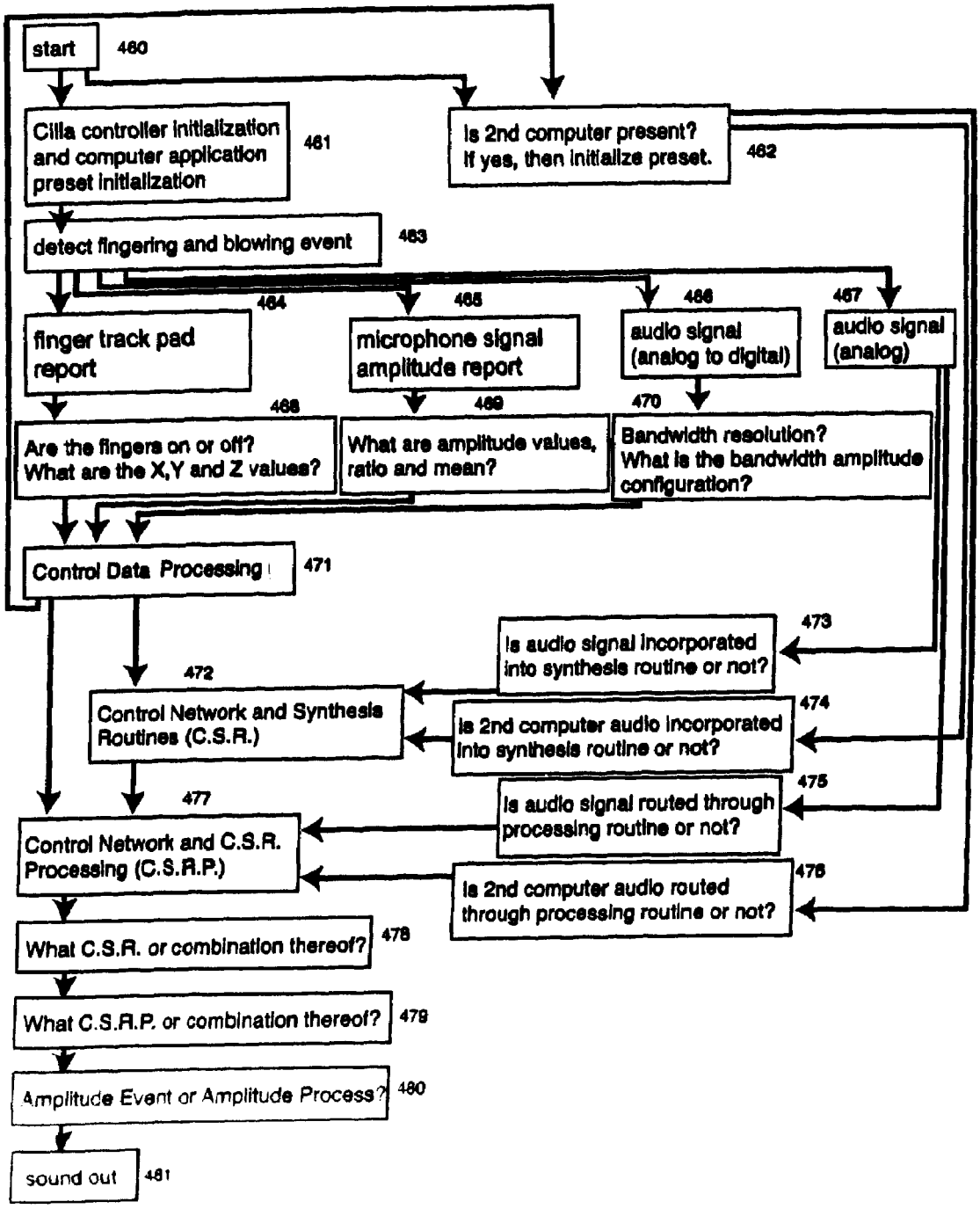
FIG. 9 is a flowchart depicting the software routine for the sound generation process of a first embodiment of the invention.
Figure 15:
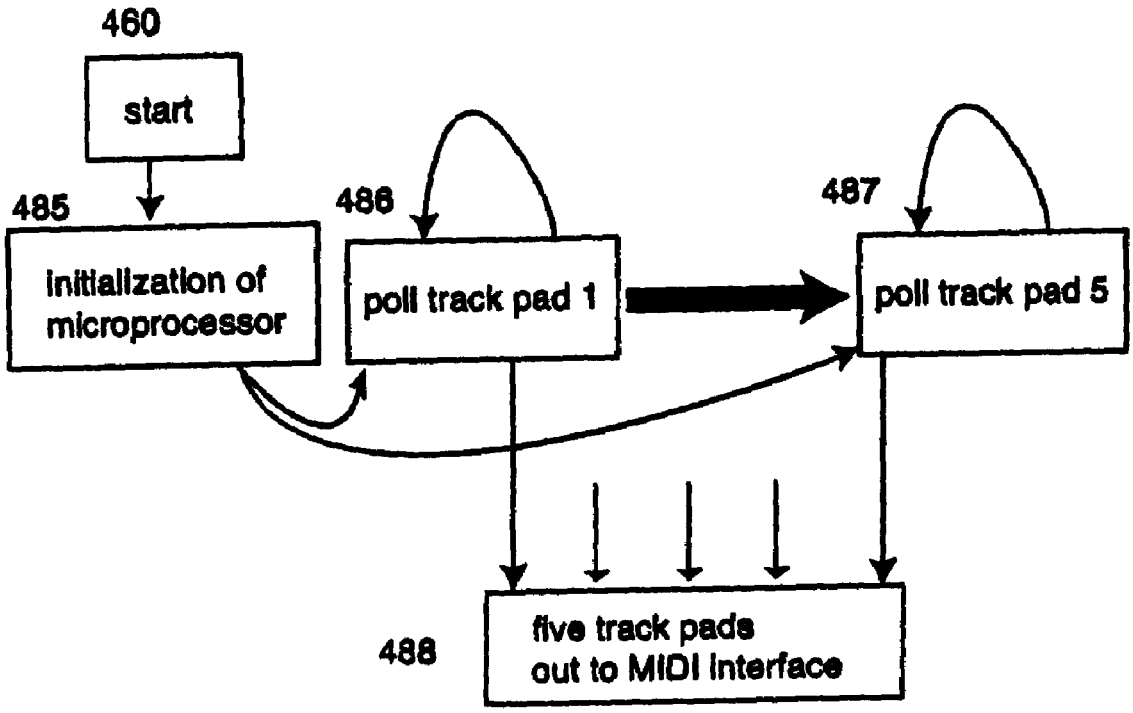
FIG. 15 is a flowchart depicting a polling process.

FIG. 9 is a flowchart depicting the main software routine executed by the computer. The equipment is turned on at step 460. The microprocessor on the flute controller and the first computer are initialized at step 461. Presets are also initialized at step 461. Presets are data sets that enable a large number of control decisions to be made at once. Upon selection of a particular preset, the data set causes the software of the system to perform the operations specified by the data set instead of those that might be specified by the microphone and finger pad inputs. For example, different presets can be used to generate different note sequences. If a second computer is used, then it too is initialized at step 462. At step 463, the software routine detects fingering and blowing events performed by a player. Illustratively, this is done by polling each microphone and track pad, in turn, as depicted in FIG. 15.

Upon positive detection of an event by the software routine, four actions follow. First, the finger track pad data (digital data converted from analog) is processed at step 464 with regard to its on/off status, and its X, Y and Z parameter values are forwarded at step 468. Second, the microphone signal amplitude data (digital data converted from analog) is processed at step 465 with regard to two amplitude stream values, as well as derivative data (namely, mean, maximum, and ratio) and this data is forwarded at step 469. Third, any audio signal (breath noise, in digital format converted from analog) is processed at step 466 with regard to bandwidth amplitudes. Bandwidth resolution is variable, and upon its determination, bandwidth amplitude configurations are forwarded at step 470. This process is likewise in effect in other embodiments of the invention where a microphone array is used and where conventional use of the microphones is employed (FIG. 3A and FIG. 3C). Fourthly, an analog audio signal is forwarded at step 467 for possible inclusion in synthesis and processing routines 473, 475. This process is also likewise in effect in other embodiments of the invention where a microphone array is used and where further conventional use of the microphones is employed (FIG. 3A and FIG. 3C).

The sensor control data forwarded at steps 468, 469, 470 is processed at step 471 and output to networks 472, 477. Network 472 includes Control Network and Synthesis Routines (C.S.R.) that are used to control the synthesis of sound. In a preferred embodiment, there are three such routines, a noise generator, a complex synthesizer and an additive synthesizer described more fully in conjunction with FIG. 10. The signals representative of synthesized sound that result from such routines are routed and further processed by network 477. Further details of this processing are also disclosed in conjunction with FIG. 10. The processing of the C.S.R. by network 477 is itself controlled by control data (C.S.R.P.) from step 471. The control data from step 471 is also forwarded to the second computer, if any, where it is implemented in independent synthesis routines at step 462. As with the audio signals, the second computer audio output can be routed as an audio signal for possible inclusion at step 474 in the synthesis routine and at step 478 in the processing routine.

Particular C.S.R.s or combinations thereof are selected at step 478. Upon such selection, particular C.S.R.P.s or combinations thereof are selected at step 479. Since such selections affect the entirety of the system, they are handled with presets, data sets which enable large numbers of decisions to be made at once. The presets can be selected by control data generated at step 471, or through manual selection from the keyboard of the computer, or from predetermined timed sequences. For example, a player can scroll through presets at will using preset timings, or basing the clocking on more 'subjective' clocks such as the number of completed phrases (e.g., complete two complete phrases before scrolling to the next present in the predetermined sequence of presets). It is also possible to set 'interval' triggers and frequency pattern triggers. For example, if a basic note sequence 1, 2, 3 and 4 is played, then preset #5 is played; and if a basic note sequence 2, 4, 2 and 4 is played, then preset #10 is played.

For each of several channels of sound so far generated, amplitude envelope selection is then made at step 480. Amplitude envelopes can be shaped directly by the player's breath, or through a process independent of the player's breath, or through some combination thereof. Such decisions are also handled by presets. After the selection is made, the resulting sound is output to a conventional sound amplification system at step 481.

The computer software program for the flute control driven dynamic synthesis system (File name: CiliaASCII.txt; Created: Mar. 27, 2006; Size (bytes): 201,000) is attached to the file of this patent application on a CD-ROM, with identical Copy 1 and Copy 2, and is incorporated by reference herein.

FIG. 10 provides further details of the synthesis routine of network 472 and the processing routine of network 477. Those elements included in bracket 341 relate to C.S.R. network 472 of FIG. 9 and those elements included in bracket 342 relate to C.S.R.P. network 477 of FIG. 9.

The synthesizer functions include: a complex FM synthesizer 345 where "FM" indicates frequency modulation; an additive synthesizer 360; and a broadband white noise generator 340. The processing functions include: a "brick wall" filter 385; a two source cross synthesizer 390; an amplitude envelope generator 395; a re-synthesizer 415, a granular synthesizer 420 and a direct out 425. A term designation of "mix" on an item indicates a designation that any source connected to an item can pass through in any combination in the course of the designated process.

Control data from the finger track pads and the microphone, are routed to every part described in FIG. 10, with the exception of the broadband white noise generator 340 and the two source cross synthesizer 390 (the portion of it excluding the mixers).

Complex FM synthesizer 345 implements routines for cascading frequency modulation. It is characterized as complex because it is one of four parts of the synthesis path. It implements two waveform synthesis routines: a cascading FM routine, and a ring modulation routine. Synthesizer 345 is described in more detail in conjunction with FIG. 11.

Additive synthesizer 360 is a sinusoidal generator that is capable of both sinusoidal addition and of waveform transformation. Synthesizer 365 is described in more detail in conjunction with FIGS. 12 and 13.

The "brick wall" filter 385 blocks any frequency not specified within a defined bandwidth. The "brick wall" filter 385 is a "spectral" filter, wherein this term implies a functional designation of filtering done in the digital domain, not the signal domain. The conversion into the data domain requires a Fast Fourier Transform (FFT) of the signal data numbers.

In an alternative embodiment of the invention, which employs conventional microphone use (FIG. 3A and FIG. 3C), data input signals from the player's breath sound are used in the synthesis signal paths. In one such embodiment, the breath sound is converted into the digital domain and used to generate additional control data through bandwidth filtering and combined filter bandwidth analysis as at step 470 of FIG. 9. In a second such embodiment, the breath sound is retained as an analog signal and either incorporated by step 473 of FIG. 9 into a synthesis function (through signal multiplication and addition), or routed at step 475 of FIG. 9 into a processing function.

In an alternative embodiment of the invention, which employs unconventional microphone use, a broadband white noise generator 340 is used and dynamically controlled with "brick wall" filter 385. In this embodiment, the sound generated by the microphones is not utilized for the purpose of detecting direct audio input, primarily because its frequency character shows insignificant change over time, and further because it occupies a small mid-range bandwidth.

The two-source cross synthesizer 390 takes two original signal sources and recombines only certain aspects of those two sources into one new source, creating an audio morphing. This is a spectral procedure—that is, one performed on the digital data representing the frequency and amplitude spectra of the audio signal. Because it is a two source synthesizer, it needs two mixers. Typically, such a synthesizer takes the amplitude spectral data of one source and recombines it with the frequency spectral data of a second source.

The amplitude envelope generator 395 is operable to give the sound coming from the speaker (the very end of the sound generating process) an intuitive connection with the breath of the player. When breath from the player is registered on the instrument, this module insures that sound will follow which is commensurate in scope with the effort of blowing that the player demonstrates. To accomplish this, it resolves technical problems, such as: it enables quick response to breath contours; it resolves "jitters" or sudden large jumps in the breath signal data; and it smoothes the data at breath amplitude thresholds and thereby removes "glitches" or registrations of amplitude that are not intended musically. Further details of envelope generator 395 are set forth in FIG. 14.

The re-synthesizer 415, also a spectral processor, takes the audio signal thus far processed, reproduces the frequency spectrum as a signal, but only with some specified original frequency content. The result in the sound is subtractive: frequencies are removed.

The granular synthesizer 420 functions to break up the source into samples whose size, separation, and pitch can be controlled. Finger track pad data is hardwired directly into this module. The granular synthesizer 420 enables both textural as well as timbre modifications of the source material.

Figure 11:
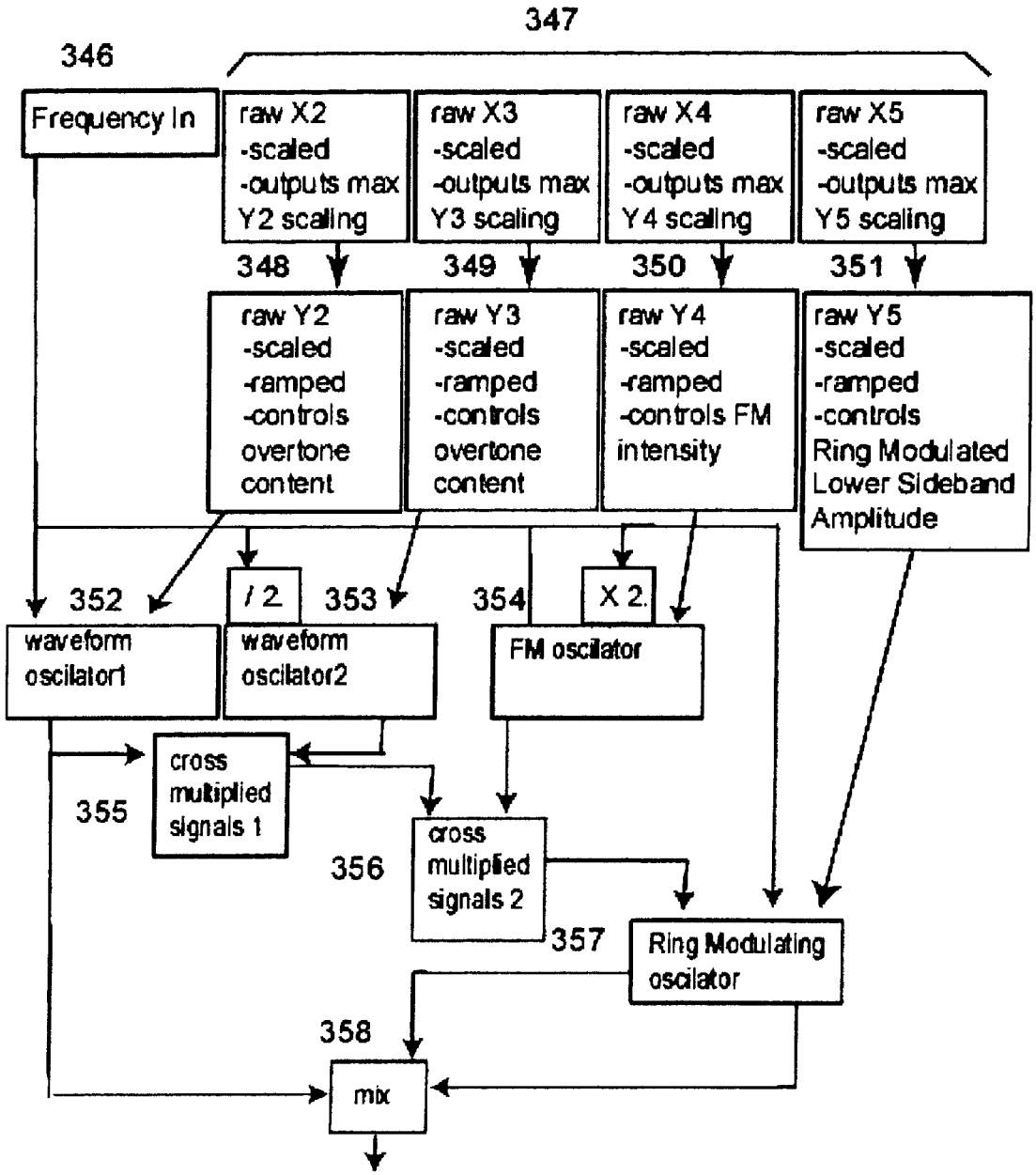
FIG. 11 is a flowchart depicting a first synthesizer.

FIG. 11 provides further details of complex synthesizer 345. The X parameters of the four finger track pads 230, 235, 240, 245 are scaled at step 347, and used to control the maximum scaling value of the Y parameters from the same four track pads at steps 348, 349, 350, 351. If a player were to move his finger in a zigzag pattern, he would consistently hear a different result. The most linear sonic gesture would result from executing diagonals with the finger. This is being used to change the amplitude of one of four steps in a four part synthesis procedure. On the one hand, in changing the amplitudes of parts within the complex synthesis patch, the fingers function like faders on a mixer within the Complex FM synthesizer. However, the signals that result from these finger controls undergo signal multiplication at three points 355, 356, 357. Therefore the finger controls affect not only the amplitude content, but also indirectly the frequency and timbre content. This is an example of a minimum amount of efficiently deployed dynamic control producing an optimized spectrum of sonic results.

The Y parameters from track pads 230, 235, 240, 245 are scaled and ramped at steps 348, 349, 350, 351, respectively. As noted above, the maximum scaling values of the Y parameters are controlled by the X parameters from the same track pad. The outputs of steps 348, 349, 350, 351 and input frequency in 346 are supplied to first waveform oscillator 352, second waveform oscillator 353, FM oscillator 354 and ring modulating oscillator 357 as follows. Frequency in 346 is derived from basic fingerings 331 of FIG. 8. First waveform oscillator 352 uses parameter Y based data from left index finger track pad 230 to determine overtone content 348 in the input frequency signal. Second waveform oscillator 353 uses parameter Y based data from left ring finger track pad 235 to determine overtone content 349 in the input frequency signal. FM oscillator 354 uses parameter Y based data from right index finger track pad 240 to determine frequency modulation intensity 350 in the input frequency signal. Ring modulating oscillator 357 uses parameter Y based data from right ring finger track pad 245 to determine amplitude of the lower sideband of the ring modulation 351.

The output of waveform oscillator 1 and waveform oscillator 2 are combined at 355 to produce cross-multiplied signals 1. The cross-multiplied signals 1 are combined at step 356 with the output of FM oscillator 354 to produce cross-multiplied signals 2. The cross-multiplied signals 2 are combined with the input frequency by ring modulating oscillator 357. Finally, the output of waveform oscillator 1 and the output of ring modulating oscillator 357 are combined by mixer 358.

It can be appreciated by those of skill in the art that the arithmetical variations of this synthesis engine are almost infinite. In one embodiment, one of the arithmetic configurations is to have clearly identifiable sonic results associable with every distinctive control gesture and combination of control gestures.

It can be appreciated by those of skill in the art that a number of ways for synthesis of control data can be implemented without departing from the spirit and scope of the present invention. Without being limiting, examples include variations in dynamic control configurations. Some synthesis implementations of the control data are more effective than others. There are two general criteria for evaluating the efficacy of dynamic control configurations. First, when considering the control combinations abstractly (without reference to their control destination) one can eliminate from scrupulous scrutiny complex combinations where one controller negates or compromises the effect of another. Two controllers inversely affecting the amplitude of a synthesis procedure will either average the amplitude with a single value (in the case where the mean is being produced), or create a constant jitter between disparate values (in the case where the control data is routed through the same ramping procedure). Second, the generated results should not involve undue self-cancellations when considering the control combinations with reference to their control destination. The player will be able to sense when there is an inappropriate degree of sonic response to an executed physical gesture. These variations appeal to a principle of efficiency: physical effort should not be wasted and routines should not be excessive. A player should be able to perform complex idiosyncratic synthesis routines and to catch such moments of waste by practice, playing and listening. It can be appreciated by the person of skill in the art, as is self-evident from the development history of any instrument, that the instrument maker anticipates results through science and calculation, but corrects, adjusts and modifies only after playing and listening.

Figure 12:
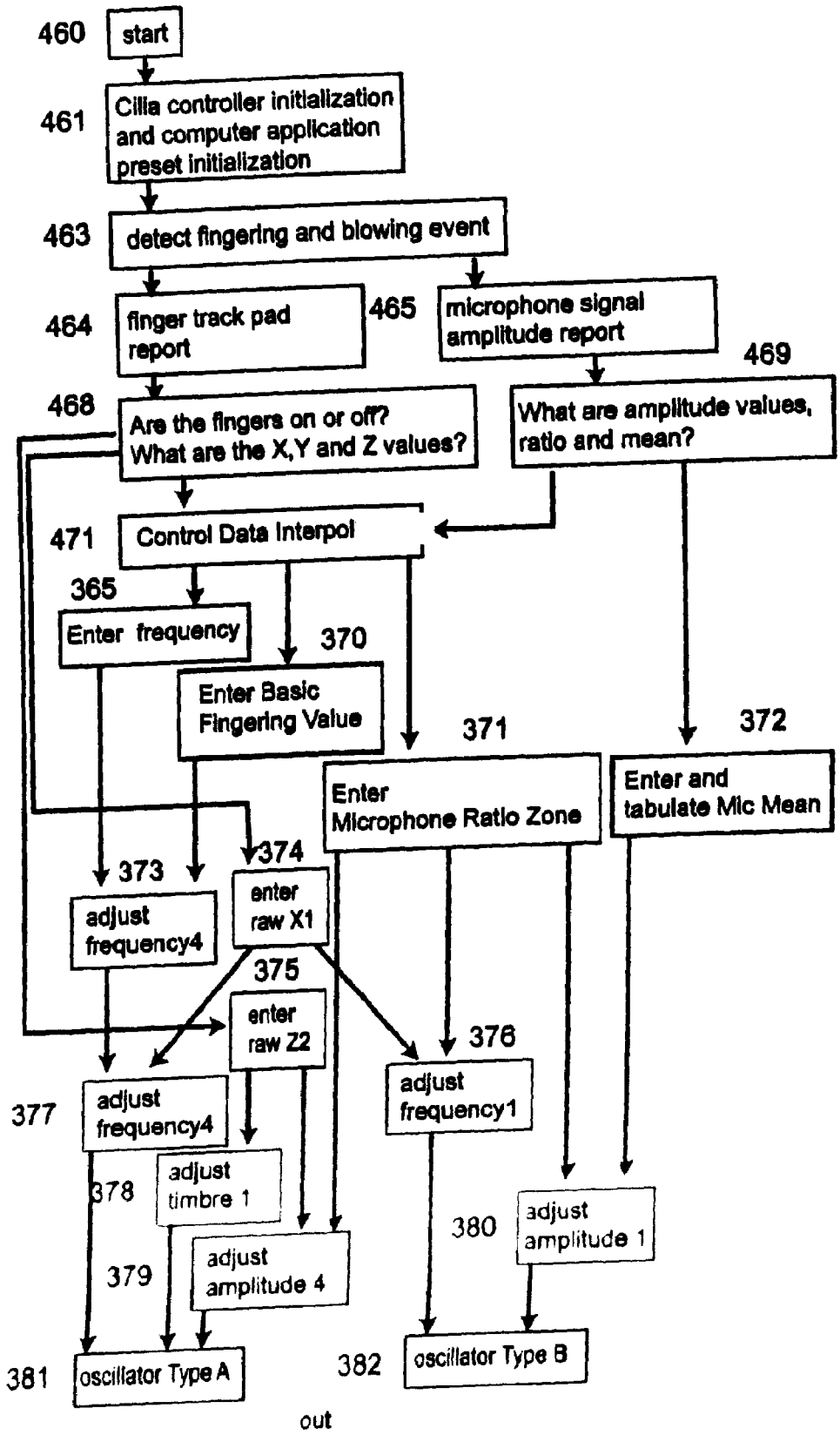
FIGS. 12 and 13 are flowcharts depicting a second synthesizer.

FIG. 12 provides further details of synthesizer 360. This flowchart depicts the processing associated with two oscillators A and B. The actual device has seven oscillators, four of type A and three of type B. The first few steps describe the actions leading up to and making possible sound generation with this module, including: initialization step 461 including preset initialization, detection of fingering and blowing events at step 463, reporting on finger movement at step 464, reporting on microphone signal amplitudes at step 465, determination of X, Y, Z values at step 468, and determination of microphone amplitude values, ratio and mean at step 469.

FIG. 12 further demonstrates principles of basic controller split into two and further rejoinder at a later point in different forms. From the determination of the basic amplitude data, in terms of microphone amplitude, microphone amplitude ratio, and mean averaging at step 469, the data can go in two directions: either to control a data processing step 471 with finger data, or to tabulation of the microphone mean value data at step 372. Tabulation step 372 refers to the mapping of the original microphone mean data onto a table, whereby the original values become pointers corresponding to different corresponding values represented in the table. The data processing step 471 yields at step 371 a new datum called microphone ratio zone 371. Further details of the generation of the microphone ratio zone are described in conjunction with FIG. 7. The microphone ratio zone is, in turn, combined with the tabulated microphone mean data, at which point the two different processed versions of the original microphone mean data are rejoined. This is not only dynamic control, but self-regulating control as well.

FIG. 12 further depicts two other dimensions of control network complexity with respect to control destination. Oscillator type A 381 uses a phasing technique to generate different overtone series and distortion qualities. In contrast, oscillator type B 382 is a simple sine wave generator. These different oscillators demonstrate how control network complexity will be determined in part by the complexity of the type of synthesis destination. Oscillator type B 382 is a simple synthesizer, because sine waves have no overtone structure. As pure fundamental tones, they can be manipulated only in terms of frequency and amplitude which parameters are supplied as outputs from a first adjust frequency step 376 and a first adjust amplitude step 380. Oscillator type A is slightly more complex. In addition to frequency and amplitude, it produces overtone content. The initial frequency is combined with a basic fingering from step 370 to produce a second adjusted frequency at step 373. This is adjusted again at step 377 through combination with X-data 374 from the thumb track pad 225 before it reaches its destination in oscillator type A 381. The overtone content is controlled by the output from first adjust timbre step 378 which is controlled by Z data 375 from the left index finger track pad 230. Z data 375 is also combined at step 379 with microphone ratio data from step 371 to adjust amplitude and this output is supplied to oscillator type A 381.

Figure 13:
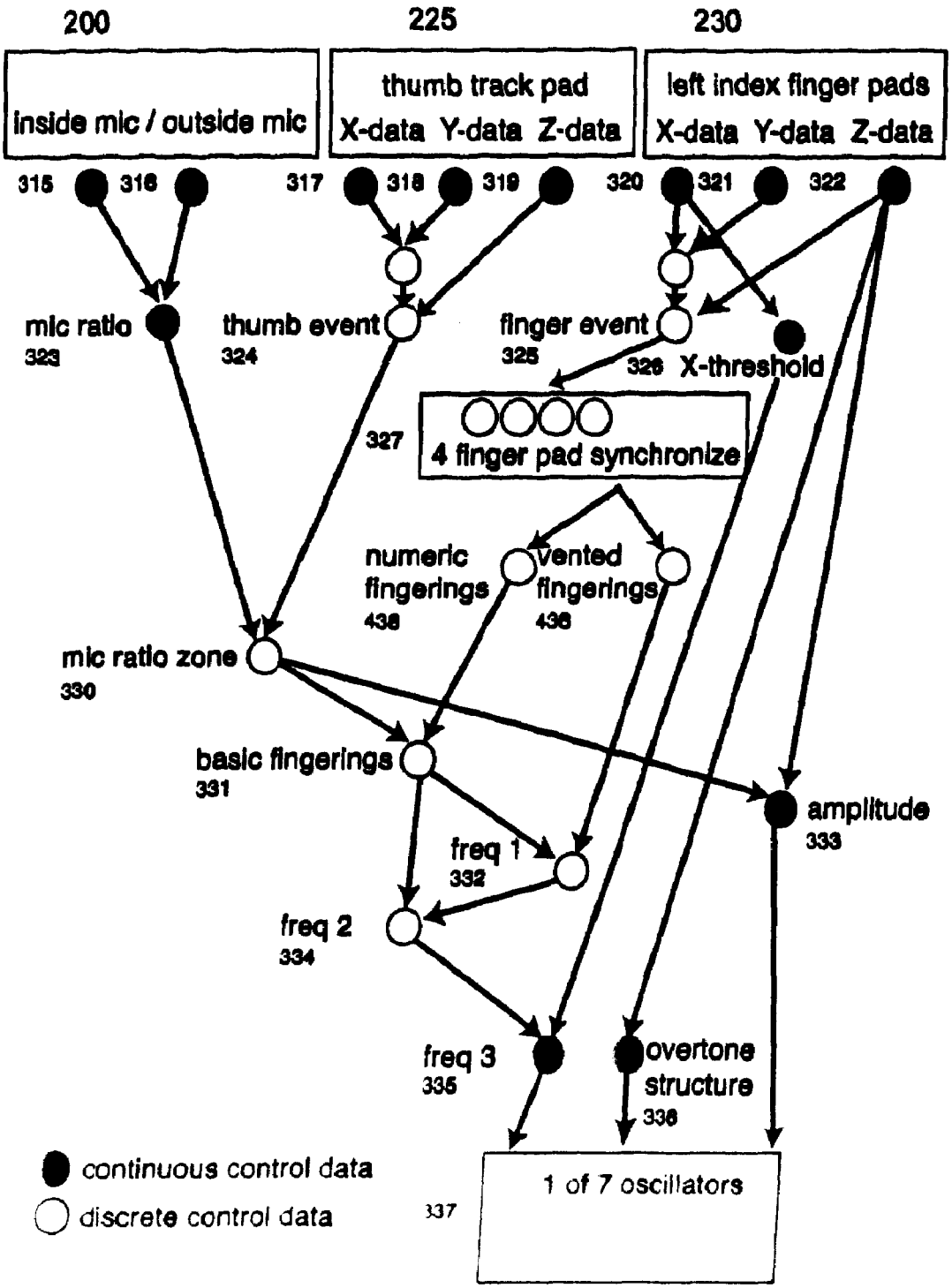

FIG. 13 provides further details of the control network of synthesizer 360. The network of FIG. 13 is one of seven substantially identical control networks, each one of which is associated with a different one of the seven oscillators of FIG. 12.

The data is directly derived from the mouthpiece 200 through signal amplitude sensing provided by the microphones 205 and 215, and from finger track pads 225, 230, 235, 240, 245 through finger shading sensing. The raw microphone data is identified as data 315, 316. The raw thumb track pad data 430 is delivered to the application as X-data 317, Y-data 318, and Z-data 319. The left index track pad data is delivered to the application as X-data 320 Y-data 321 and Z-data 322. In similar fashion but not shown, the left ring finger pad X-data, Y-data and Z data are combined in the same way and routed to the second of the four type A sound generators. The right index finger pad X-data, Y-data and Z data are combined in the same way and routed to the third of the four type A sound generators. The right ring finger pad X-data, Y-data and Z data X-data, Y-data and Z data are combined in the same way and routed to the fourth of the four type A sound generators. As indicated by the filled in circle, all the raw data is continuous data meaning that there are no discernable steps. The raw microphone data undergoes preliminary processing which is identical for each of the two microphones. From the processed data from the first and second microphones, a microphone amplitude ratio 323 is obtained as described in more detail in conjunction with FIG. 7.

As indicated in conjunction with FIG. 12, the additive synthesizer 360 generates seven independent audio signals using seven software oscillators. In the case of the type A oscillators, each such signal results from combination of three data streams. In the embodiment of FIG. 13, these streams are the freq3 stream 335, the overtone structure stream 336 and the amplitude stream 333. These three streams correspond to the three inputs to oscillator type A 381 of FIG. 12. In the embodiment of the invention shown in FIG. 13, the first data stream freq3 335 results from several processing operations including: microphone ratio 323, thumb event 324, microphone ratio zone 330, basic fingerings 331, freq1 332, freq2 334, four finger pad synchronizer 327 and left index finger event 325. As more fully described in conjunction with FIG. 8, the four finger pad synchronizer 327 produces a fingering output that includes numeric fingerings 438 and vented fingerings 436. These are direct derivations or readings from the four finger pad synchronizer 327. In the embodiment of the invention shown in FIG. 13, second data stream overtone structure 336 is determined directly by the Z-data from one of the finger pads. In the embodiment of the invention shown in FIG. 13, the third data stream amplitude 333 results from four processing operations, including microphone ratio 323, thumb event 324, microphone ratio zone 330, and amplitude 333.

The complexity of the three final stages of control data is achieved through indirect control networking. It draws from several factors, including: generating and combining data streams from both breath and finger actions either alone or in combination; generating both continuous control and discrete control data (represented as filled or outlined circles, respectively), and the inherent complexity of the sensors themselves, where either a breath or a finger action immediately is capable of producing complex streams of data. Although the second controller stream overtone structure 336 is a direct feed from a finger pad Z parameter, it is still complex by virtue of being produced simultaneously with an X and a Y parameter and is not combined with other data from the network, and is accordingly also a dynamic form of control on the sound.

Figure 14:
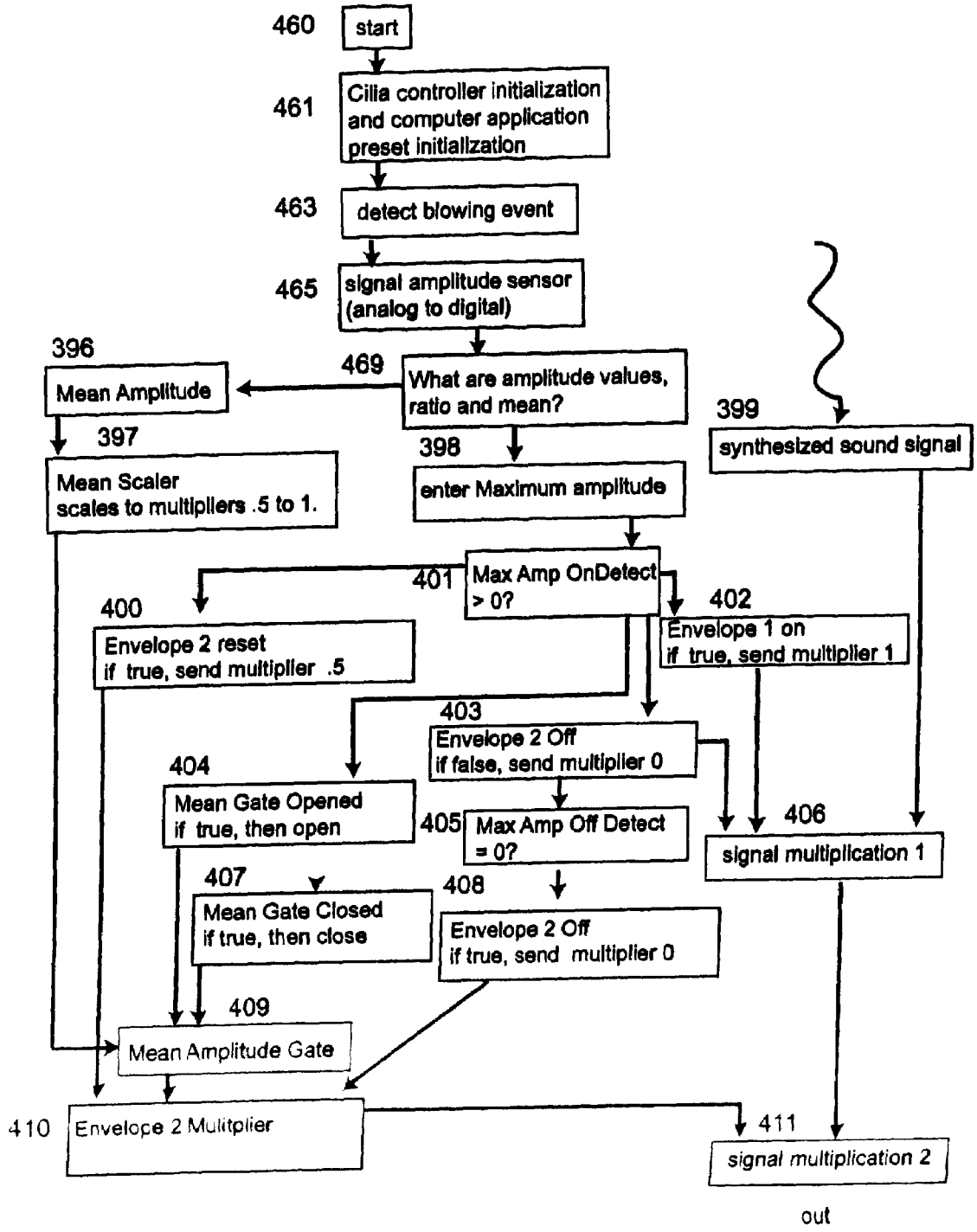
FIG. 14 is a flowchart depicting an envelope generator.

FIG. 14 provides further details of the amplitude envelope generator. The initial steps include: an initialization step 461 including preset initialization, a detection of a blowing event at step 463, a report on microphone signal amplitudes at step 465, and determination of microphone amplitude values, ratio and mean at step 469. As described in conjunction with FIG. 7, the microphone 205 and 215 signal amplitude data undergoes a first set of manipulations to remove jitters and to smooth out the data. Once the basic amplitude data manipulations have been performed at step 469, the resulting data streams can be further used in generating envelopes that specify the overall dynamic shape of a musical gesture. Amplitude envelope generation is a controlled variable multiplication of the audio signal. The envelope generation is handled at two points, first signal multiplication 406 and second signal multiplication 411. Truth value monitors 402 (envelope 1 on) and 403 (envelope 1 off) determine on the basis of detector 401 (maximum amplitude on) whether signal multiplication 1 406 has a value of "0" which is silence, or "1" which is the full given signal amplitude received from the synthesized sound signal 399.

The multiplication value of second signal multiplication 411 is more complex. Truth value monitors 400 (envelope 2 reset), 403 (envelope 1 off), 404 (mean gate opened), 405 (maximum amplitude off detector), 407 (mean gate closed), and 408 (envelope 2 off) determine collectively whether the mean amplitude gate 409 allows mean amplitude control data 396 adjusted by the mean scaler 397 to determine a second stage of signal multiplication 411. If mean amplitude control data 396 is allowed through the mean amplitude gate 409, then the output signal amplitude 411 will be variable, but always in the audible range as the mean amplitude values have been scaled by scaler 397 from 0.5 (which is ½ of the original signal amplitude) to 1 which is the full original signal volume assuming that first signal multiplication 406 is set at multiplier value 1. If the mean amplitude gate 409 is closed, then automatic ramping procedures go into effect. Truth value monitor 408 (envelope 2 off) looks to maximum amplitude off detector 405 to determine if second signal multiplication 411 should be ramped down to multiplier value 0, effectively turning it off. The effect in sound is that the breath of the player has stopped and the synthesized sound lingers before ramping down.

Truth value monitor 400 (envelope 2 reset) looks to detector 401 (maximum amplitude on) to determine if second signal multiplication 411 should be ramped up to multiplier value 0.5, effectively setting it in a ready position to receive the signal from first signal multiplication 406. In this case, second signal multiplication 411 is again subject to mean amplitude 396 control because the mean amplitude gate 409 is opened by truth value monitor 404 (mean gate opened) which is responding to a positive value from detector 401 (maximum amplitude on detector).

Amplitude data received at this stage in the program still demonstrates jitter at the threshold of silence. A player may think that he is playing a rest, but some little transient jitter such as the accidental smacking of the lips causes a little amplitude bump. Again the acoustic flute paradigm is instructive in shaping a program solution.

The interior acoustics of the shakuhachi tube (resonances, reflections and resistances) enables ramping of the volume into silence easily. Strictly speaking, reflected sound continues after the player stops blowing. It is certainly true with a room, but also at a micro-level within the space of the shakuhachi tube. Reflected sound is simulated not by using a conventional effect such as reverb, but by using delayed ramping.

The maximum volume 398 activates an attack portion of the ramped envelope 402 which freezes at that level 406 until it receives a '0' value from the maximum amplitude of the two microphones. When the breath stops, the maximum amplitude reads zero, triggering the fixed first envelope 406 down to zero. And upon this zero, the modifying amplitude envelope 410 also slopes down to zero. There is always a controlled ramping down after the breath has stopped.

The second problem happens when controllers are inflexibly stable. The mean amplitude 396 is used to modify the first amplitude envelope as when the mean amplitude gate 409 is opened.

The first signal multiplication 406 holds the amplitude at one level as long as the player blows at whatever volume. There are micro-inconsistencies, moments of indecision or decision in the breath technique of wind players which make for nuance and vitality. To retain this vitality, the second signal multiplication 411 introduces micro variation in the amplitude, but with a stability provided by first signal multiplication 406.

It will be apparent to those of skill in the art that other signal amplitude sensor and microphone models and arrays can also function—within the spirit and scope of the present invention—to capture alternative variations in the quantity of calculation and the amount of control.

Variations in discrete control can be based on detecting and amplifying input data streams, including, but not limited to, the following control parameters: volume of each microphone individually, mean volume, maximum rough volume, maximum volume, continuous ratio and ratio threshold.

In one embodiment of the invention, tubes 298 and 296, as depicted in FIG. 2B and FIG. 4C, are made from aluminum. It will be apparent to the skilled artisan to replace the aluminum tubing with tubing made from other materials, particularly materials which both contribute to the light-weight of the instrument and provide a sturdy support.

In a wireless embodiment of the invention, the flute controller may be heavier and less ergonomic due to the need for battery power. In an alternative ergonomic light design embodiment of the flute controller, a design solution to the heavier weight may be found, without any limitation, by tethering the transmitter and battery to an external unit fastened to the player's belt or clothing.

It can be appreciated by those of skill in the art that embodiments of the invention that require use of more than two microphones may, without limitation, require audio transmission re-engineering due to an increase of the weight of the instrument when the controller is outfitted with the additional components needed for multi-channel (greater than stereo) wireless audio transmission.

In an alternative light-weight embodiment of the invention, additional microprocessors may be introduced such as to allow for the basic analog-to-digital conversion of the microphone signal to be done on the flute controller itself.

In one alternative light-weight embodiment of the invention, a second microprocessor may be implemented, particularly in association with the use of low resolution (8-bit) analog-to-digital conversion processing. It is an object of the present invention to provide a means for simplification of the data conversion process. It can be appreciated by those of skill in the art that where the instrument utilizes an unconventional use of the microphones as amplitude sensors, the application of low (8-bit) resolution data may serve to both convert the control data as well as simplify the data manipulation process involved in such a conversion. This engineering advantage resides with the ability to transmit control data with greater ease than audio signals, as less control data is required to be transmitted at lower resolutions.

In one embodiment of the invention, the Bluetooth wireless technology may be utilized. It can be appreciated by the person of skill in the art that there are numerous available technologies for wireless transmission of control data.

In an alternative embodiment of the invention, which uses the additional microphone in a conventional way (as in FIG. 3A and FIG. 3C), the requisite transmission of an audio signal also occurs at low resolution. Without being limiting, an adequate use of low resolution signals may be achieved for purposes of tracking timbre shifts in the breath sound such as to allow the detection of pitch-bandwidth thresholds within the breath sound of the player.

We claim:

1. A controller for an electronic musical instrument comprising:

a housing;

a mouthpiece mounted on the housing, said mouthpiece comprising a wind separator having first and second surfaces and a microphone mounted on each of the first and second surfaces; and a plurality of sensors mounted on the housing and positioned so that a player's fingers can engage the sensors while the mouthpiece is held to his or her mouth, wherein the sensors produce signals indicative of fingering events including the number of fingers on the sensors, wherein the fingering events include vented fingerings and non-vented fingerings.

2. The controller of claim 1 wherein the sensors are track pads.

3. The controller of claim 1 wherein there are five sensors.

4. The controller of claim 3 wherein the sensors are positioned to be engaged by two fingers of each hand and one thumb.

5. The controller of claim 1 wherein the mouthpiece further comprises a lip plate.

6. The controller of claim 1 further comprising an amplifier for amplifying output signals from each microphone.

7. The controller of claim 2 further comprising a microprocessor for processing signals from each track pad.

8. The controller of claim 1 further comprising a wireless transmitter for transmitting signals from the microphones and sensors.

9. The controller of claim 1 wherein each microphone functions as a signal amplitude sensor responding to friction noise resulting from blowing of air directly onto the microphone.

10. The controller of claim 1 further comprising a third microphone mounted on the mouthpiece to amplify a player's breath sound in conventional fashion.

11. An electronic musical instrument comprising:

a controller comprising:

a housing, a mouthpiece mounted on the housing, said mouthpiece comprising a wind separator having first and second surfaces and a microphone mounted on each of the first and second surfaces; and a plurality of sensors mounted on the housing and positioned so that a player's fingers can engage the sensors while the mouthpiece is held to his or her mouth;

a processor for processing signals from the microphones to produce a first output signal;

a processor for processing signals from the sensors to produce a second output signal, wherein signals from the sensors are processed to determine fingering events including the number of fingers on the sensors, wherein the fingering events include vented fingerings and non-vented fingerings; and a first synthesizer responsive to said first and second output signals to produce a first sound synthesis signal for controlling an audio speaker.

12. The electronic musical instrument of claim 11 wherein the sensors are track pads.

13. The electronic musical instrument of claim 11 wherein there are five sensors.

14. The electronic musical instrument of claim 13 wherein the sensors are positioned to be engaged by two fingers of each hand and one thumb.

15. The electronic musical instrument of claim 11 wherein signals from the microphones are processed to determine a ratio of the amplitude between the two microphones.

16. The electronic musical instrument of claim 11 further comprising:

a noise generator;

a second synthesizer responsive to said first and second output signals to produce a second sound synthesis signal for controlling an audio speaker; and an amplitude envelope generator for combining an output of said noise generator and said first and second sound synthesis signals.

17. The electronic musical instrument of claim 11 wherein the first synthesizer is implemented in computer software.

* * * * *